US010142743B2

(12) United States Patent
Anderson

(10) Patent No.: US 10,142,743 B2
(45) Date of Patent: Nov. 27, 2018

(54) PARAMETRICALLY FORMULATED NOISE AND AUDIO SYSTEMS, DEVICES, AND METHODS THEREOF

(71) Applicant: Dean Robert Gary Anderson, Orem, UT (US)

(72) Inventor: Dean Robert Gary Anderson, Orem, UT (US)

( * ) Notice: Subject to any disclaimer, the term of this patent is extended or adjusted under 35 U.S.C. 154(b) by 40 days.

(21) Appl. No.: 15/396,686

(22) Filed: Jan. 1, 2017

(65) Prior Publication Data

US 2017/0195800 A1 Jul. 6, 2017

Related U.S. Application Data

(60) Provisional application No. 62/274,240, filed on Jan. 1, 2016.

(51) Int. Cl.
*H04R 25/00* (2006.01)

(52) U.S. Cl.
CPC ..... *H04R 25/505* (2013.01); *H04R 25/353* (2013.01); *H04R 25/43* (2013.01); *H04R 25/502* (2013.01); *H04R 25/453* (2013.01); *H04R 2225/43* (2013.01); *H04R 2430/01* (2013.01)

(58) Field of Classification Search
CPC ..... H04R 2225/43
See application file for complete search history.

(56) References Cited

U.S. PATENT DOCUMENTS

| | | | | |
|---|---|---|---|---|
| 3,385,937 | A * | 5/1968 | Lafon | H04R 25/353 381/316 |
| 3,781,491 | A * | 12/1973 | Biondi | H04R 25/353 381/150 |
| 5,197,332 | A | 3/1993 | Shennib | |
| 5,325,436 | A | 6/1994 | Soli et al. | |
| 5,396,560 | A | 3/1995 | Arcos et al. | |
| 5,717,767 | A | 2/1998 | Inanaga et al. | |
| 5,825,894 | A | 10/1998 | Shennib | |
| 5,868,682 | A | 2/1999 | Combs et al. | |
| 5,870,481 | A | 2/1999 | Dymond et al. | |

(Continued)

FOREIGN PATENT DOCUMENTS

| | | | |
|---|---|---|---|
| EP | 1933590 | A1 | 6/2008 |
| GB | 2394632 | A | 4/2004 |

(Continued)

OTHER PUBLICATIONS

Sakamoto et al.; "Frequency compression hearing aid for severe-to-profound hearing impairments"; Oct. 2000. Auris Nasus Larynx; vol. 27. Issue 4; pp. 327-334.

(Continued)

*Primary Examiner* — Ryan Robinson
(74) *Attorney, Agent, or Firm* — Daniel Anderson

(57) ABSTRACT

In one embodiment, an audio system can generate a parametrically formulated noise signal which can be mixed with an audio signal or acoustic signal. According to an embodiment, a parametrically formulated noise signal can be configured to have a power spectrum amplitude that is a function of frequency. According to an embodiment, a parametrically formulated noise signal can have a power spectrum amplitude across a range of frequencies that is a function of an individual's hearing thresholds across the range of frequencies.

18 Claims, 22 Drawing Sheets

(56) References Cited

U.S. PATENT DOCUMENTS

| | | | | |
|---|---|---|---|---|
| 5,878,146 | A | 3/1999 | Andersen | |
| 5,923,764 | A | 7/1999 | Shennib | |
| 6,167,138 | A | 12/2000 | Shennib | |
| 6,201,875 | B1 | 3/2001 | Davis et al. | |
| 6,236,731 | B1 | 5/2001 | Brennan et al. | |
| 6,389,142 | B1 | 5/2002 | Hagen et al. | |
| 6,567,524 | B1 | 5/2003 | Svean et al. | |
| 6,574,342 | B1 | 6/2003 | Davis et al. | |
| 6,577,740 | B1 | 6/2003 | Bordewijk | |
| 6,674,862 | B1 | 1/2004 | Magilen | |
| 6,731,769 | B1 | 5/2004 | Lenhardt | |
| 6,885,752 | B1 | 4/2005 | Chabries et al. | |
| 6,912,289 | B2 | 6/2005 | Vonlanthen et al. | |
| 7,058,188 | B1 | 6/2006 | Allred | |
| 7,206,423 | B1 | 4/2007 | Feng et al. | |
| 7,418,379 | B2 | 8/2008 | Vierthaler | |
| 7,502,483 | B2 * | 3/2009 | Rikimaru | H04R 25/505 381/320 |
| 7,903,833 | B2 | 3/2011 | Goldberg et al. | |
| 8,094,834 | B1 | 1/2012 | Brungart | |
| 8,553,897 | B2 | 10/2013 | Anderson | |
| 8,879,745 | B2 | 11/2014 | Anderson | |
| 8,942,397 | B2 * | 1/2015 | Anderson | H04R 25/50 381/316 |
| 9,101,299 | B2 | 8/2015 | Anderson | |
| 9,491,559 | B2 | 11/2016 | Anderson | |
| 2003/0142746 | A1 | 7/2003 | Tanaka et al. | |
| 2004/0006283 | A1 | 1/2004 | Harrison et al. | |
| 2004/0076301 | A1 | 4/2004 | Algazi et al. | |
| 2006/0008102 | A1 | 1/2006 | Westergaard | |
| 2006/0182294 | A1 | 8/2006 | Grasbon et al. | |
| 2006/0204013 | A1 | 9/2006 | Hannibal et al. | |
| 2006/0210090 | A1 | 9/2006 | Shennib | |
| 2007/0127753 | A1 | 6/2007 | Feng | |
| 2007/0223720 | A1 | 9/2007 | Goldberg | |
| 2009/0116657 | A1 | 5/2009 | Edwards et al. | |
| 2009/0208024 | A1 | 8/2009 | Farver et al. | |
| 2010/0316240 | A1 * | 12/2010 | Semcken | H04M 1/2475 381/331 |
| 2011/0150256 | A1 | 6/2011 | Baechler et al. | |
| 2011/0170711 | A1 | 7/2011 | Rettelbach | |
| 2017/0289708 | A1 * | 10/2017 | Nielsen | H04R 25/505 |

FOREIGN PATENT DOCUMENTS

| | | | | |
|---|---|---|---|---|
| WO | WO 03063546 | A1 * | 7/2003 | H04R 25/60 |
| WO | 2008141672 | A1 | 11/2008 | |

OTHER PUBLICATIONS

Alger, Alexandra. "A Chip in the Ear." FORBES. Nov. 2, 1998.

Gelfand, Stanley A. Essentials of Audiology, Third Edition, Mar. 2009, Thieme, p. 250-253.

Edgar Villchur, "Signal Processing to Improve Speech Intelligibility in Perceptive Deafness", The Journal of the Acoustical Society of America, vol. 53, No. 6, 1973, pp. 1646-1657 (Abstract) (https://asa.scitation.org/doi/abs/10.1121/1.1913514).

Ghent, Robert M., Jr. et al. "Interactive Binaurally Balanced Fittings for Improved Audibility, Reduced Costs, and Fewer Return Visits" The Hearing Review, Nov. 3, 2011.

Kraus, Eric M., MD, et al., "Envoy Esteem Totally Implantable Hearing System : Phase 2 Trial, 1-Year Hearing Results," Otolaryngology—Head and Neck Surgery, American Academy of Otolaryngology, Mar. 31, 2011.

* cited by examiner

```
[01] //              Parametrically Formulated Noise Generators
[02] //              WRITTEN IN "C" PROGRAMMING LANGUAGE:
[03]
[04] // INITIALIZE VARIABLES:
[05] // Create "random" and give it an initial seed value:
[06] volatile uint16_t   random = 0xACE1u;
[07] // Create "random_number" to store a new random_number:
[08] uint16_t   random_number;
[09]
[10] // A function used by either method to generate a random number:
[11] uint16_t   get_random_number( void )
[12] {   // This function uses a "Galois Linear Feedback Shift Register":
[13]         // Create "lsb" to store the least significant bit of "random".
[14]         uint16_t   lsb;
[15]         //  Get the least significant bit "lsb" of the variable "random":
[16]         lsb = random & 1;
[17]         random >>= 1;     // Right shift "random" by 1 bit.
[18]         if( lsb == 1 )      // If the "lsb" is 1:
[19]                 random ^= 0xB400u;    // Apply a toggle mask with XOR.
[20]         return( random );      // Return the new random number.
[21] }     // End Function: get_random_number().
[22]
[23] // INITIALIZED VARIABLES FOR METHOD 1 (using 16 kHz clocking):
[24] // Look-up-table for: 2000 Hz...clocked samples for 3 cosine waves:
[25] int24_t   samples_2000hz[24] = { 8388607,  5931640,  0, -5931641,
[26]         -8388607, -5931641, -1, 5931640, 8388607, 5931640, 0,
[27]         -5931641, -8388607, -5931641, -1, 5931640, 8388607, 5931640,
[28]         0, -5931641, -8388607, -5931641, -1, 5931640 };   // 24-bit res.
[29] // Look-up-table for: 2462 Hz...clocked samples for 4 cosine waves:
```

FIG. 5A

```
[30] int24_t   samples_2462hz[26] = { 8388607, 4765271, -2974642,
[31]          -8144850, -6278963, 1011134, 7427742, 7427742, 1011134,
[32]          -6278963, -8144850, -2974642, 4765271, 8388607, 4765271,
[33]          -2974642, -8144850, -6278963, 1011134, 7427742, 7427742,
[34]           1011134, -6278963, -8144850, -2974642, 4765271 };   // 24-bit.
[35] // Create "count" for number of samples to output:
[36] int16_t   count = 24;      // Set "count" for 3 full cycles at 2000 Hz.
[37] // Create an address pointer "look_up_table":
[38] int24_t * look_up_table = samples_2000hz; // Set address for 2000 Hz.
[39] // Create "output_value_24" for data to Digital-to-Analog Converter:
[40] int24_t   output_value_24;
[41]
[42] // The following "while" loop could be included in a function used
[43] // to create Parametrically Formulated Noise using Method 1:
[44] while(1)
[45]          {
[46]          count--;      // Decrement the "count" value.
[47]          wait_for_16kHz_clock_tick();   // Wait for next 16kHz clock tick.
[48]          // Determine the next output_value to send:
[49]          output_value_24 = *(look_up_table + count);
[50]          // Send the output_value to the Digital-to-Analog Converter:
[51]          DAC_output_24( output_value_24 );
[52]          if( count == 0 )      // If "count" equals 0.
[53]                    {
[54]                    // Get a new random_number:
[55]                    random_number = get_random_number();
[56]                    // Make the random_number either 0 or 1.
[57]                    random_number &= 1;
[58]                    // Is the new random_number equal to 1?
```

FIG. 5B

```
[59]                if( random_number == 1 )
[60]                        {       // Use the look-up-table data for 2462 Hz:
[61]                        look_up_table = samples_2462hz;
[62]                        // Number of samples for 4 full cycles at 2462 Hz:
[63]                        count = 26:
[64]                        }       // End: Is the new random_number equal to 1?
[65]                else     // Else new random_number must equal 0.
[66]                        {       // Use the look-up-table data for 2000 Hz:
[67]                        look_up_table = samples_2000hz;
[68]                        // Number of samples for 3 full cycles at 2000 Hz:
[69]                        count = 24:
[70]                        }       // End: Else new random_number equals 0.
[71]                }     // End: If "count" equals 0.
[72]        }     // End: "while" loop for Method 1.
[73]
[74]  // INITIALIZE VARIABLES FOR METHOD 2 (using 32 kHz clocking):
[75]  // Look-up-table for: 4000 Hz...clocked samples for 3 cosine:
[76]  int16_t   cos4000Hz[24] = { 32767, 23169, 0, -23170, -32767, -23170,
[77]          -1, 23169, 32767, 23169, 0, -23170, -32767, -23170, -1, 23169,
[78]           32767, 23169, 0, -23170, -32767, -23170, -1, 23169 };  // 16-bit.
[79]  // Look-up-table for: 4740 Hz...clocked samples for 4 cosine:
[80]  int16_t   cos4740Hz[27] = { 32767, 19567, -9398, -30791, -27377,
[81]          -1906, 25100, 31883, 12978, -16384, -32546,  -22487, 5689,
[82]          29281, 29281, 5689, -22487, -32546, -16384, 12978, 31883,
[83]          25100, -1906, -27377, -30791, -9398, 19567 };     // 16-bit res.
[84]  // Look-up-table for: 5120 Hz...clocked samples for 4 cosine:
[85]  int16_t   cos5120Hz[25] = { 32767, 17557, -13952, -32509, -20887,
[86]          10125, 31737, 23886, -6140, -30466, -26510, 2057, 28713,
[87]          28713, 2057, -26510, -30466, -6140, 23886, 31737, 10125,
```

FIG. 5C

```
[88]          -20887, -32509, -13952, 17557 };          // 16-bit resolution.
[89]   // Look-up-table for: 5818 Hz...clocked samples for 4 cosine:
[90]   int16_t   cos5818Hz[22] = { 32767, 13611, -21458, -31440, -4664,
[91]          27565, 27565, -4664, -31440, -21458, 13611, 32767, 13611,
[92]          -21458, -31440, -4664, 27565, 27565, -4664, -31440, -21458,
[93]          13611 };   // 16-bit resolution.
[94]   // Create "count_a" and "count_b" for number of samples to output:
[95]   int16_t   count_a = 24;      // Set "count_a" for 3 full cycles at 4000 Hz.
[96]   int16_t   count_b = 25;      // Set "count_b" for 4 full cycles at 5120 Hz.
[97]   // Create address pointers "look_up_table_a" and "look_up_table_b":
[98]   int16_t * look_up_tables_a = cos4000Hz;   // Set address for 4000 Hz.
[99]   int16_t * look_up_tables_b = cos5120Hz;  // Set address for 5120 Hz.
[100]  // Create "output_value_32" for data to Digital-to-Analog Converter:
[101]  int32_t   output_value_32;
[102]
[103]  // The following "while" loop could be included in a function used
[104]  // to create Parametrically Formulated Noise using Method 2:
[105]          while(1)
[106]          {
[107]          count_a--;      // Decrement the "count_a" value.
[108]          count_b--;      // Decrement the "count_b" value.
[109]          // Determine the next output_value to send:
[110]          output_value_32 = *(look_up_table_a + count_a)
[111]                                  + *(look_up_table_b + count_b);
[112]          wait_for_32kHz_clock_tick(); // Wait for next 32kHz clock tick.
[113]          // Send the output_value to the Digital-to-Analog Converter:
[114]          DAC_output_32( output_value_32 );
[115]          // Get a new random_number:
[116]          random_number = get_random_number();
```

FIG. 5D

```
[117]   // Make the random_number either 0 or 1.
[118]   random_number &= 1;
[119]   if( count_a == 0 )      // If "count_a" equals 0.
[120]           {
[121]           if( random_number == 1 ) // If random_number equals 1.
[122]                   {       // Use the look-up-table_a data for 4740 Hz:
[123]                   look_up_table_a = cos4740Hz;
[124]                   // Number of samples for 4 full cycles at 4740 Hz:
[125]                   count_a = 27:
[126]                   }       // End: If new random_number equals 1?
[127]           else     // Else new random_number equals 0.
[128]                   {       // Use the look-up-table data for 4000 Hz:
[129]                   look_up_table_a = cos4000Hz;
[130]                   // Number of samples for 3 full cycles at 4000 Hz:
[131]                   count_a = 24:
[132]                   }       // End: Else new random_number equals 0.
[133]           }     // End: If "count_a" equals 0.
[134]   if( count_b == 0 )      // If "count_b" equals 0.
[135]           {
[136]           if( random_number == 1 ) // If random_number equals 1.
[137]                   {       // Use the look-up-table_b data for 5818 Hz:
[138]                   look_up_table_b = cos5818Hz;
[139]                   // Number of samples for 4 full cycles at 5818 Hz:
[140]                   count_b = 22:
[141]                   }       // End: If random_number equals 1.
[142]           else     // Else random_number equals 0.
[143]                   {       // Use the look-up-table_b data for 5120 Hz:
[144]                   look_up_table_b = cos5120Hz
[145]                   // Number of samples for 4 full cycles at 5120 Hz:
```

FIG. 5E

```
[146]                    count_b = 25:
[147]                    }     // End: Else random_number equals 0.
[148]              }     // End: If "count_b" equals 0.
[149]        }     // End: "while" loop for Method 2.
```

FIG. 5F

PARAMETRICALLY FORMULATED NOISE AND AUDIO SYSTEMS, DEVICES, AND METHODS THEREOF

CROSS-REFERENCE TO RELATED APPLICATIONS

This application claims priority to U.S. Provisional Application No. 62/274,240 filed on Jan. 1, 2016, the content of which is hereby incorporated by reference.

BACKGROUND

The present invention relates, in general, to electronics and, more particularly, to audio systems, devices, and methods.

Speech understanding or speech intelligibility is critical for effective communication and thus is of particular concern to the designer and user of almost any audio system. One example audio system for which speech intelligibility is of critical importance is the hearing aid. Vast amounts of time and money have been invested into improving the speech intelligibility of hearing aids over the last century. Improvements such as electric hearing aids were introduced more than 100 years ago. Digital signal processing was added to hearing aids more than 25 years ago.

Despite these improvements and their long history, however, modern hearing aids continue to suffer from a myriad of problems. For example, hearing aids are expensive. Typically, a pair of hearing aids can cost between $1,500 and $6,000. In some instances, hearing aids can cause additional hearing loss to the user's residual hearing. By their nature, conventional hearing aids operate by amplifying sound. However, over-amplification can result in additional hearing damage to the user's remaining hearing. Over-amplification is prevalent due to imprecise measurements of patient hearing thresholds, problematic fitting protocols, large speaker and microphone tolerances, and user demand for additional amplification as a solution for ineffective hearing aids.

Short battery life is another problem area for hearing aids. Hearing aid users can become frustrated with the nuisance of frequently changing or charging batteries. Feedback caused by the recursive pick up and amplification of the hearing aid's own output signal can result in disruptive and uncomfortable squealing noises. Furthermore, many hearing aid users are self-conscious about the aesthetics of hearing aids and are uncomfortable wearing visible hearing aids in public. Earwax accumulation, frequent maintenance, skin irritation, occlusion effect, the list of problems for users of hearing aids goes on and on. And yet, despite all of these problems, one of the most troubling and frequently complained about problems of hearing aids is that they are ineffective, particularly in noisy environments.

Accordingly, it is desirable to have an audio system, device, and method for solving at least the above mentioned problems, and in particular, it is desirable to have a hearing aid which is effective in improving speech understanding and speech intelligibility, especially in noisy environments.

BRIEF DESCRIPTION OF THE DRAWINGS

FIGS. 5A-5F illustrates a computer program listing in accordance with an embodiment of the present invention;

Figure 1:
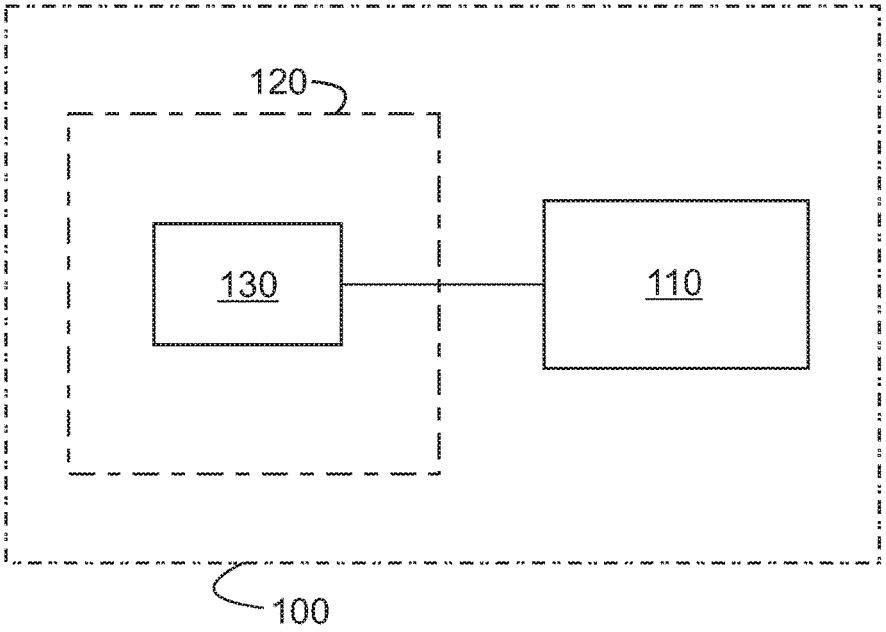
FIG. 1 illustrates a schematic diagram of a parametrically formulated noise generator in accordance with an embodiment of the present invention.

The drawings and detailed description are provided in order to enable a person skilled in the applicable arts to make and use the invention. The systems, structures, circuits, devices, elements, schematics, signals, signal processing schemes, flow charts, diagrams, algorithms, frequency values and ranges, amplitude values and ranges, methods, source code, examples, etc., and the written descriptions are illustrative and not intended to be limiting of the disclosure. Descriptions and details of well-known steps and elements are omitted for simplicity of the description.

For simplicity and clarity of the illustration, elements in the figures are not necessarily drawn to scale, and the same reference numbers in different figures denote the same elements.

As used herein, the term and/or includes any and all combinations of one or more of the associated listed items. In addition, the terminology used herein is for the purpose of describing particular embodiments only and is not intended to be limiting of the disclosure. As used herein, the singular forms are intended to include the plural forms as well, unless the context clearly indicates otherwise. It will be further understood that the terms comprise, comprises, comprising, include, includes, and/or including, when used in this specification and claims, are intended to specify a non-exclusive inclusion of stated features, numbers, steps, acts, operations, values, elements, and/or components, but do not preclude the presence or addition of one or more other features, numbers, steps, acts, operations, values, elements, components, and/or groups thereof. It will be understood that, although the terms first, second, etc. may be used herein to describe various signals, portions of signals, ranges, members, and/or elements, these signals, portions of signals, ranges, members, and/or elements should not be limited by these terms. These terms are only used to distinguish one signal, portion of a signal, range, member, and/or element from another. Thus, for example, a first signal, a first portion of a signal, a first range, a first member, and/or a first element discussed below could be termed a second signal, a second portion of a signal, a second range, a second member, and/or a second element without departing from the teachings of the present disclosure. It will be appreciated by those skilled in the art that words, during, while, concurrently, and when as used herein related to audio systems, devices, methods, signal processing and so forth, are not limited to a meaning that an action, step, function, or process must take place instantly upon an initiating action, step, process, or function, but can be understood to include some small but reasonable delay, such as propagation delay, between the reaction that is initiated by the initial action, step, process, or function. Additionally, the terms during, while, concurrently, and when are not limited to a meaning that an action, step, function, or process only occur during the duration of another action, step, function, or process, but can be understood to mean a certain action, step, function, or process occurs at least within some portion of a duration of another action, step, function, or process or at least within some portion of a duration of an initiating action, step, function, or process or within a small but reasonable delay after an initiating action, step, function, or process. Furthermore, as used herein, the term range, may be used to describe a set of frequencies having an approximate upper and approximate lower bound, however, the term range may also indicate a set of frequencies having an approximate lower bound and no defined upper bound, or an upper bound which is defined by some other characteristic of the system.

The term range may also indicate a set of frequencies having an approximate upper bound and no defined lower bound, or a lower bound which is defined by some other characteristic of the system. Reference to "one embodiment" or "an embodiment" means that a particular feature, structure, or characteristic described in connection with the embodiment is included in at least one embodiment of the present disclosure. Thus, appearances of the phrases "in one embodiment" or "in an embodiment" in various places throughout this specification are not necessarily all referring to the same embodiment, but in some cases it may. The use of words about, approximately or substantially means a value of an element is expected to be close to a stated value or position. However, as is well known in the art there are always minor variances preventing values or positions from being exactly stated. It is further understood that the embodiments illustrated and described hereinafter suitably may have embodiments and/or may be practiced in the absence of any element that is not specifically disclosed herein. Furthermore, it is understood that in some cases the embodiments illustrated and described hereinafter suitably may have embodiments and/or may be practiced with one or more of the illustrated or described elements, blocks, or signal processing steps omitted.

It is noted that while the invention described herein is described in context of audio systems, devices, and methods, the invention will also find application in many mechanical, electrical, power, and communications systems, devices, and methods.

Those skilled in the art will understand that as used herein, the term acoustical frequencies can refer to a range of frequencies associated with the range of frequencies generally audible to humans, for example, from about 20 Hertz ("Hz") to about 20,000 Hz. In addition, as used herein, acoustical frequencies can also refer to any frequency or frequency range where the invention described herein may find application. For example, in mechanical, electrical, power, or communications systems, devices or methods where, for example, resonance or resonant frequencies can be problematic, the invention described herein could be implemented to dampen or eliminate problems associated with resonance or resonant frequencies.

Those skilled in the art will understand that as used herein, the term noise can refer to many different types of noise. For example, and without limiting the disclosure, noise may mean: a sound signal with a single fixed frequency and amplitude, a warbled tone, a chirping sound, a hiss, a rumble, a crackle, a hum, a popping sound, multiple tones, a signal having a randomly changing frequency and a randomly changing amplitude over time, incoherent noise, coherent noise, a combination of tones having random frequencies and random amplitudes, a combination of tones having random frequencies and fixed amplitudes, a random sound signal, uniformly distributed noise from a pseudorandom noise generator, "white noise," "pink noise," "Brownian noise" (i.e., "red noise"), and/or "Grey noise", etc. Furthermore, "noise" may also include noise substantially within a range of frequencies wherein the noise comprises a signal having a substantially constant amplitude and having a randomly changing period corresponding to frequencies within a range of frequencies as described hereinafter. Furthermore, the randomly changing period can change as frequently as each cycle.

Those skilled in the art will understand that as used herein, the terms add, added, adding, mix, mixed, or mixing may refer to any type of combination or summation of elements, signals, portions of signals, amplitudes, numbers, values, variables, sets, arrays, or objects. For example, the use of the terms add, added, adding, mix, mixed, or mixing may indicate electronic addition or mixing, numerical addition or mixing, digital addition or mixing, analog addition or mixing, or mechanical addition or mixing, such as air conduction mixing of acoustic signals.

Those skilled in the art will understand that as used herein, the terms weight, weighting, or weighted can refer to making a value proportional to another value or can refer to adjusting a value by multiplication with a fixed constant such as a fixed constant less than 1.0, a fixed constant greater than 1.0, or a fixed constant equal to 1.0. Weight, weighting, or weighted may refer to amplifying, attenuating, or holding constant (e.g. doing nothing). Weight, weighting, or weighted can also refer to multiplying or modulating one signal by a second signal.

Those skilled in the art will understand that as used herein, the terms replace, replaced, replacing, or replacement, when used in conjunction with sound signals or frequencies of sound signals, is not limited just to the elimination of a sound signal or frequencies of a sound signal and the provision of a substitute, but the terms may also refer to reducing or attenuating a sound signal or frequencies of a sound signal and the provision of a substitute. The terms may also refer to overwriting a sound signal or portion of a sound signal with a substitute. Furthermore, the terms may also refer to superimposing one signal on top of another signal or on top of a portion of a sound signal.

Those skilled in the art will understand that as used herein, the terms audio device or audio system can refer to a stand-alone system or a subsystem of a larger system. A non-limiting list of example audio systems can include: hearing aids, personal sound amplification products, televisions, radios, cell phones, telephones, computers, laptops, tablets, vehicle infotainment systems, audio processing equipment and devices, personal media players, portable media players, audio transmission systems, transmitters, receivers, public address systems, media delivery systems, internet media players, smart devices, hearables, recording devices, subsystems within any of the above devices or systems, or any other device or system which processes audio signals.

As herein described or illustrated, components, elements, or blocks that are connected, coupled, or in communication may be electronically coupled so as to be capable of sending and/or receiving electronic signals between electronically coupled components, elements, or blocks, or linked so as to be capable of sending and/or receiving digital or analog signals, or information, between linked components, elements, or blocks. Coupling or connecting components, elements, or blocks as described or illustrated herein does not foreclose the possibility of including other intervening components, elements or blocks between the coupled or connected components, elements, or blocks. Coupling or connecting may be accomplished by hard wiring components elements or blocks, wireless communication between components, elements, or blocks, on-chip or on-board communications and the like.

Many electronic and mechanical alternatives are also possible to implement individual objectives of various components, elements, or blocks described or illustrated herein. For example, the function of a filtered volume reducer could be accomplished via a completely or partially occluding ear mold, hearing aid dome, propeller, tip, receiver, etc., or, the function of a mixer could be accomplished via air conduction mixing of two acoustic signals. Furthermore, software or firmware operating on a digital device may be used to implement individual objectives of various components, elements, or blocks described or illustrated herein.

Multiple instances of embodiments described or illustrated herein may be used within a single audio device or system. As an example, multiple instances of embodiments described or illustrated herein may enable the processing of subdivisions of the various ranges of frequencies described herein. As another example, multiple instances of embodiments described or illustrated herein may enable a stereo audio device comprising a first instance of an embodiment for a right band and a second instance of an embodiment for a left band.

The inventor is fully informed of the standards and application of the special provisions of 35 U.S.C. § 112(f). Thus, the use of the words "function," "means" or "step" in the Detailed Description of the Invention or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material, or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the illustrated embodiments, but in addition, include any and all structures, materials, or acts that perform the claimed function as described in alternative embodiments or forms of the invention, or that are well known present or later-developed, equivalent structures, material, or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software, hardware or a combination of both. It should be noted that there are many different and alternative configurations, devices, and technologies to which the disclosed inventions may be applied. Thus, the full scope of the invention is not limited to the examples that are described below.

Various aspects of the present invention may be described in terms of functional block components and various signal processing steps. Such functional blocks may be realized by any number of hardware and/or software components configured to perform the specified functions and achieve the various results. In addition, various aspects of the present invention may be practiced in conjunction with any number of audio devices, and the systems and methods described are merely exemplary applications for the invention. Further, exemplary embodiments of the present invention may employ any number of conventional techniques for audio filtering, amplification, noise generation, modulation, mixing, and the like.

It is noted that signal processing can be done in analog or digital form and various systems have a mixture of both analog and digital processes. The invention described herein can be implemented by analog or digital processes or a mixture of both analog and digital processes. Thus it is not a limitation of the invention that any particular process be implemented as either analog or digital. Those skilled in the art will readily see how to implement the invention using both analog and digital processes to achieve the results and benefits of the invention.

Various representative implementations of the present invention may be applied to any system for audio devices. For example, certain representative implementations may include: hearing aid devices and personal sound amplification products.

DETAILED DESCRIPTION OF THE DRAWINGS

FIG. 1 illustrates a schematic diagram of a parametrically formulated noise generator 100. According to an embodiment, parametrically formulated noise generator 100 can be configured to generate a parametrically formulated noise signal. Parametrically formulated noise generator 100 comprises a processor 110 and a storage device 120. Processor 110 may be any type of computing processor capable of performing operations on data, for example, processor 110 may be a microprocessor, a central processing unit ("CPU"), or a digital signal processor ("DSP"). Processor 110 may also be a combination of two or more processors, for example, processor 110 may comprise one or more processor cores or may comprise a CPU and a DSP. Processor 110 may also be integrated within a larger component, chip or system, for example, processor 110 may form a part of a system on chip ("SoC"), a microcontroller, a computer, or any type of computing device. A lookup table 130 can be stored on storage device 120. Storage device 120 may comprise any type of computing or data storage device, memory, or medium, for example, storage device 120 may comprise random access memory ("RAM"), read only memory ("ROM"), programmable read only memory ("PROM"), erasable programmable read only memory ("EPROM"), electrically erasable programmable read only memory ("EEPROM"), solid state storage, flash memory, hard disk storage, optical disk storage, or any and all types of non-volatile or volatile memory, or any combination of the foregoing.

According to an embodiment, processor 110 can be coupled to storage device 120. However, it is not a limitation that processor 110 be directly coupled to storage device 120 without any intervening elements, components, systems, or devices, nor is it a limitation that processor 110 be hard-wired to storage device 120. Those skilled in the art will recognize many ways to store and communicate information between processor 110 and storage device 120 including both wired and wireless configurations. Furthermore, according to an embodiment, processor 110 and storage device 120 can be integrated onto a single chip.

Processor 110 can be programmed to generate a noise signal. According to one embodiment, a noise signal can comprise a time ordered, random or pseudorandom, sequence of periodic waves having frequencies substantially within a first range of frequencies. Processor 110 can be configured to generate a parametrically formulated noise signal using values stored in lookup table 130. Lookup table 130 can store values corresponding to, or representative of, the amplitude of periodic waves having various frequencies, sampled at various sampling rates over various periods or amounts of time. For example, lookup table 130 may store values corresponding to or representative of the amplitude of a 2000 cycles per second or Hertz ("Hz") first periodic wave (e.g. a cosine wave) sampled at 16,000 Hz over a period of about 0.0015 seconds. Additionally, lookup table 130 may store values corresponding to or representative of the amplitude of a 2462 Hz second periodic wave (e.g. a cosine wave) sampled at 16,000 Hz over a period of about 0.001625 seconds. According to an embodiment, lookup table 130 can be configured to store a virtually unlimited number of values corresponding or representative of periodic waves of various frequencies sampled at various sampling rates over various periods of time. Furthermore, the values stored on lookup table 130 may be changed according to the hearing loss or hearing needs of an individual as described hereinafter. Furthermore, according to an embodiment, processor 110 can apply fractional multiplication techniques to values obtained from lookup table 130 in order to control a parametrically formulated noise signal which can be outputted by parametrically formulated noise generator 100. The reasonable selection of frequencies, sampling rates, and sampling periods yielding values for storage in lookup table 130 will be described hereinafter. According to various embodiments, processor 110 can be programmed or configured to generate a noise signal utilizing values from lookup table 130 stored on storage device 120. The noise signal generated by parametrically formulated noise generator 100 can be used with or as part of an audio device or audio system to improve speech understanding and speech intelligibility. Characteristics and parameters of the noise signal generated by parametrically formulated noise generator 100 can be selected, changed, or modified based on the hearing ability or hearing loss of a user of the audio device or audio system, or based on the average hearing ability or hearing loss of a population.

Figure 2:
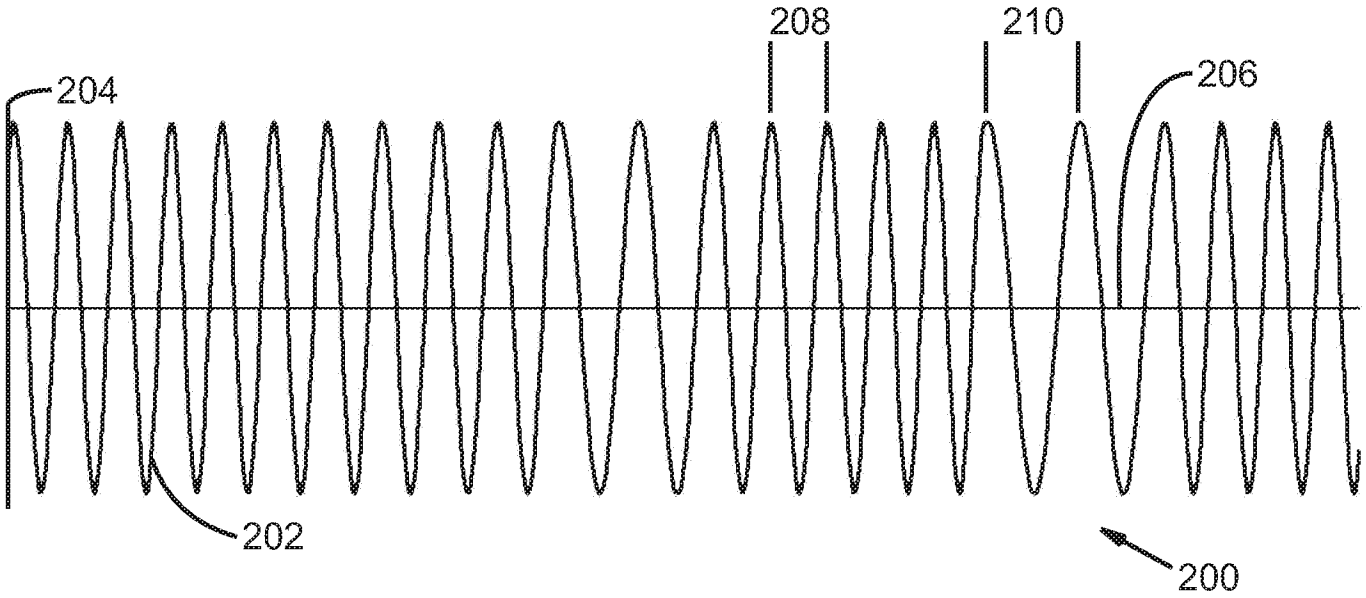
FIG. 2 illustrates a waveform graph of a parametrically formulated noise signal in accordance with an embodiment of the present invention.

FIG. 2 illustrates an example waveform graph 200 of a noise signal 202. Noise signal 202 is shown with instantaneous sound pressure 204 plotted as a function of time 206. Noise signal 202 is an example of a noise signal which can be generated by parametrically formulated noise generator 100 from FIG. 1. As shown, noise signal 202 has a substantially constant amplitude and has a randomly changing period, such as a first period 208 and a second period 210. Noise signal 202 can be generated to maintain frequencies within a range of frequencies or can be filtered to remove artifacts such that the random frequencies correspond only to frequencies within the range of frequencies. It is noted then that a parametrically formulated noise generator 100 does not necessarily perform a filtering function on all types of generated noise signals, as some noise signals can be generated to be within a particular range of frequencies and thus may not require subsequent filtering. Furthermore, the randomly changing period of the noise signal can change as frequently as each cycle.

Figure 3:
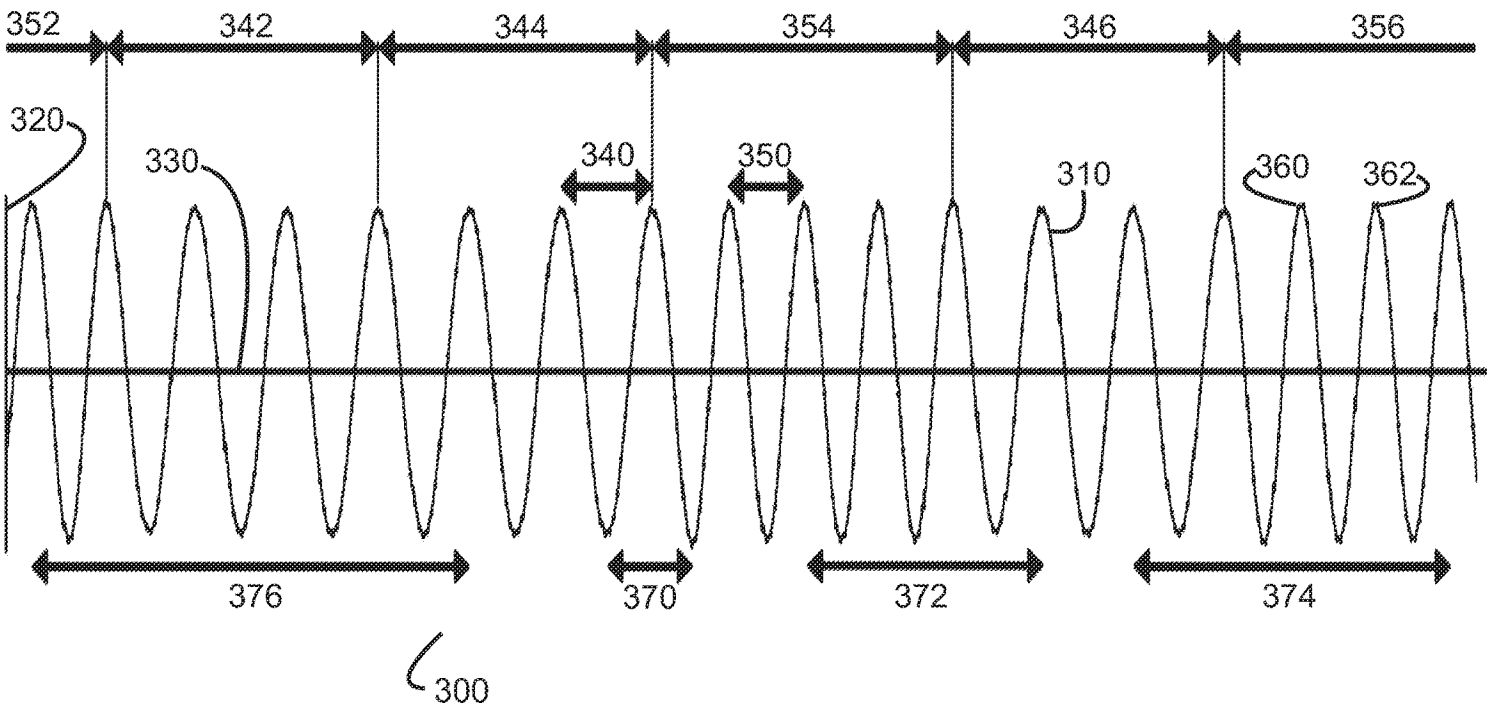
FIG. 3 illustrates a waveform graph of a parametrically formulated noise signal in accordance with an embodiment of the present invention.

FIG. 3 illustrates a waveform graph 300 of a noise, noise wave, noise signal, or parametrically formulated noise signal 310. According to an embodiment, parametrically formulated noise signal 310 was generated by parametrically formulated noise generator 100 (see FIG. 1). Parametrically formulated noise signal 310 is shown having an amplitude 320 plotted as a function of time 330. Parametrically formulated noise signal 310 comprises a noise signal substantially within a first range of frequencies, generated by time ordering, in a random or pseudorandom order, a plurality of periodic waves having frequencies within a first range of frequencies. According to an embodiment, parameters representing a ratio of duration for each of the plurality of periodic waves can be selected in order to control the power spectrum amplitude of parametrically formulated noise signal 310 across a range of frequencies. According to an embodiment, parametrically formulated noise signal 310 can be a time ordered, random or pseudorandom, sequence of a first periodic wave having a first period or first frequency 340 and a second periodic wave having a second period or second frequency 350. It is noted that the period of a periodic wave can be related to its frequency by the equation: $f=1/T$, where frepresents the frequency of the periodic wave in Hz, and T represents the period of the periodic wave in seconds. According to other embodiments, parametrically formulated noise signal 310 may comprise three or more unique periodic waves, each having a unique period/frequency. According to the present embodiment, first period 340 is a period equal to about 0.0005 seconds which represents a frequency of about 2000 Hz and second period 350 is a period equal to about 0.00040625 seconds which represents a frequency of about 2462 Hz. According to an embodiment, each periodic wave can be a cosine wave beginning at 0 degrees, noted as 360 in FIG. 3, and ending at 360 degrees, noted as 362 in FIG. 3. Equivalently, each periodic wave can be a sine curve beginning at 90 degrees, noted as 360 in FIG. 3, and ending at 450 degrees, noted as 362 in FIG. 3. Those skilled in the art will recognize other equivalent or corresponding curves or waves that can be constructed, for example, a cosine wave formulated to begin at 360 degrees and end at 0 degrees, or a cosine wave formulated to begin at −180 degrees and end at +180 degrees, or a sine wave formulated to begin at −90 degrees and end at +270 degrees, etc.

According to an embodiment, parametrically formulated noise signal 310 can be created by parametrically formulated noise generator 100 (see FIG. 1) using values stored in lookup table 130. Lookup table 130 may, for example, have stored sampled values representative of the amplitudes of first periodic wave having a first period 340 and second periodic wave having a second period 350 over a predetermined amount of time. According to an embodiment, additional periodic waves having different periods can also be created within parametrically formulated noise signal 310. For example a third period 370 comprises one half of first period 340 plus one half of second period 350. Third period 370 is a period equal to about 0.000453125 seconds (0.000453125=(0.00040625+0.0005)/2) which represents a frequency of about 2207 Hz. A fourth period 372 comprises two periods of second period 350 plus one period of first period 340. Fourth period 372 is a period equal to about 0.0013125 seconds (0.0013125=(2×0.00040625)+0.0005) which represents a frequency of about 2286 Hz. Similarly, a fifth period 374 would represent a frequency of about 2327 Hz and a sixth period 376 would represent a frequency of about 2078 Hz. In accordance with an embodiment, parametrically formulated noise signal 310 can be, in general, a frequency-hopping plurality of periodic waves yielding a continuous spread-spectrum signal between the two frequencies, for example, between about 2000 Hz and about 2462 Hz. According to an embodiment, frequency hopping can be designed to occur at specified points, for example, frequency hopping can be made to occur only at the periodic wave peaks, or alternatively only at periodic wave valleys, or alternatively only at either a periodic wave peak or a periodic wave valley.

In accordance with an embodiment, parametrically formulated noise signal 310 can comprise a random or pseudorandom, time ordered, sequence of groups of either three consecutive first periodic waves, or four consecutive second periodic waves. For example, as shown, parametrically formulated noise signal 310 comprises a first group 352 of waves having second period 350, followed by a second group 342 of three waves having a first period 340, followed by a third group 344 of three waves having a first period 340, followed by a fourth group 354 of four waves having a second period 350, followed by a fifth group 346 of three waves having a first period 340, followed by a sixth group 356 of waves having a second period 350. First group 352 and sixth group 356 are only partially shown but if completed would correspond to fourth group 354.

The duration of parametrically formulated noise signal 310 as shown in FIG. 3 if first group 352 and sixth group 356 were fully shown, is about 0.009375 seconds (0.009375=(0.0015+0.001625)×3). According to various embodiments, parametrically formulated noise can be generally unaffected by constructive wave interference because of the unstable phase relationship of successive waves (incoherence). According to an embodiment, a noise signal representing a phoneme lasting a short period of time, for example 180 milliseconds, and constructed primarily with parametrically formulated noise would remain generally un-amplified by acoustic resonances within the ear canal due to the brief and incoherent nature of the noise signal.

Figure 4:
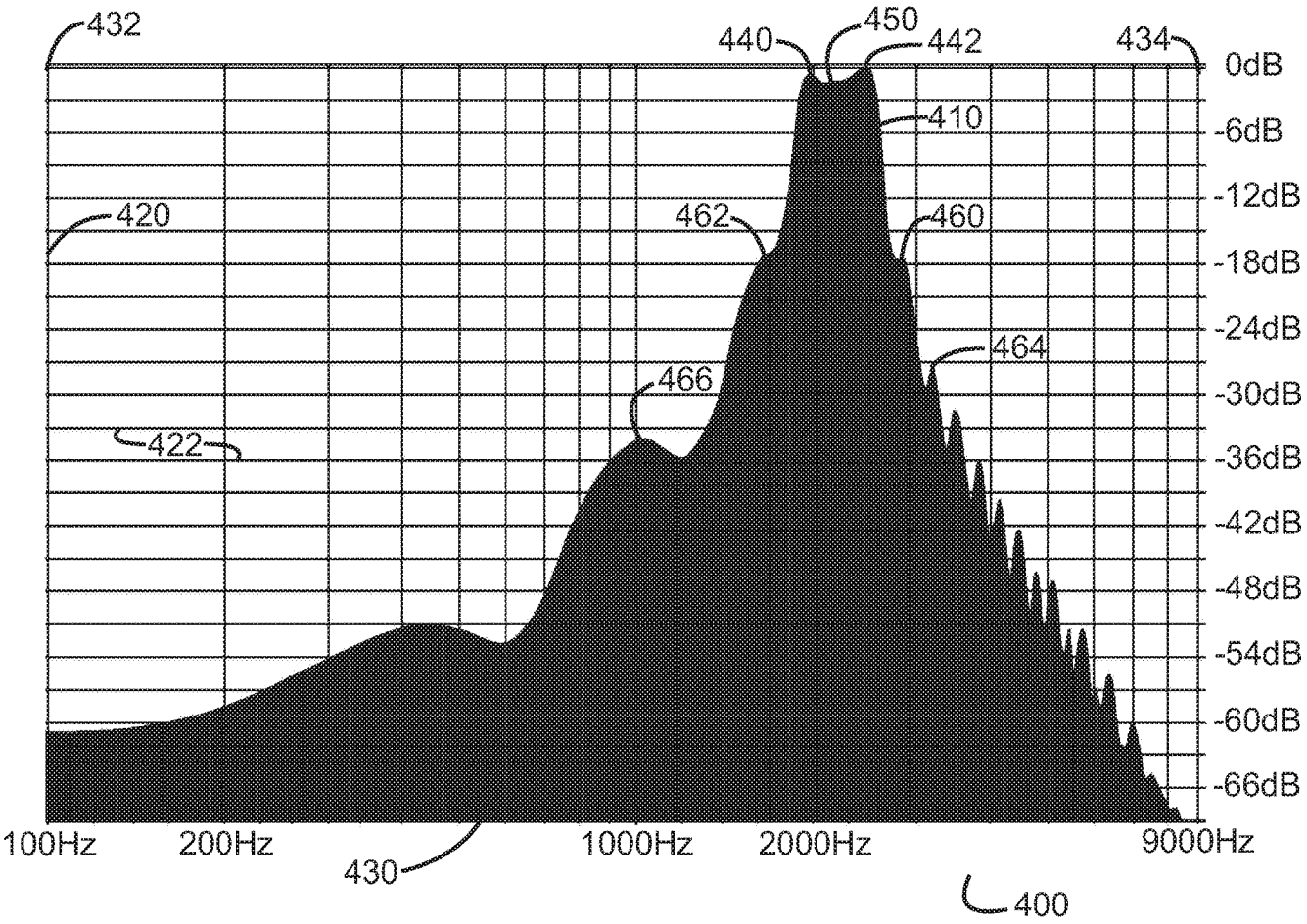
FIG. 4 illustrates a power spectrum graph of a parametrically formulated noise signal in accordance with an embodiment of the present invention.

While the occurrence of first and second periodic waves can be made random or pseudorandom, according to various embodiments, the ratio of the respective durations of various periodic waves over time within parametrically formulated noise signal 310 can be selected or set such that the power spectral density of parametrically formulated noise signal 310 is shaped according to the specific design of an audio system or device. For example, according to an embodiment, the ratio of duration of various periodic waves within a noise signal can be selected such that the average value across a power spectrum within a range of frequencies correlates to the threshold of hearing of an individual for the first range of frequencies. According to the present embodiment, the ratios of duration of the first and second periodic waves were selected such that the average amplitude of a power spectrum of the noise signal was substantially flat between 2000 Hz and 2462 Hz. According to the present embodiment, the time duration of a sequence of three first periodic waves of 2000 Hz is about 0.0015 seconds. The time duration of a sequence of four second periodic waves of 2462 Hz is about 0.001625 seconds. According to this embodiment, the duration of the sequence of four second periodic waves of 2462 Hz is about 8.33% longer than the duration of the sequence of three first periodic waves of 2000 Hz. Assuming that the sequences of three first periodic waves are selected randomly or pseudorandomly with the same probability as sequences of four second periodic waves, then the duration of second periodic waves of 2462 Hz over time will generally be about 1.0833 times longer than the duration of first periodic waves of 2000 Hz over time (1.0833=0.001625/0.0015). Accordingly, this embodiment demonstrates a parametrically formulated noise wherein a parameter or plurality of parameters, representing the ratio of duration for each of a plurality of periodic waves, were selected by design such that the average power spectrum amplitude within a first range of frequencies of the parametrically formulated noise is shaped according to the selected parameters. In this embodiment, the average power spectrum amplitude of the parametrically formulated noise signal at 2462 Hz would generally only be about 0.7 decibels (hereinafter: dB) louder than at 2000 Hz (0.7 dB=20 log 1.0833). This result is experimentally verified as shown in FIG. 4. Furthermore, according to an embodiment, the average power spectrum amplitude between 2000 Hz and 2462 Hz may not vary significantly from the average power spectrum amplitude at 2000 Hz or at 2462 Hz. Lastly, because the sequences of period waves of such parametrically formulated noise are presented in random or pseudorandom order, the parametrically formulated noise can be generated and output from an audio device or system, such as a hearing aid, having a speaker and microphone without the problems or issues associated with feedback.

Thus, according to various embodiments, a parametrically formulated noise signal can be generated wherein the average power spectrum amplitude within a range of frequencies over time is generally shaped or controlled. Parameters, such as the period/frequency, a probability of occurrence, and/or the number of periodic waves per sequence can be used to determine the general ratios of duration of each periodic wave over time. The parameters representing the ratios of duration of each periodic wave over time can be used to shape the average power spectrum amplitude of a noise signal across a range of frequencies. According to various embodiments, a parametrically formulated noise generator, or a plurality of parametrically formulated noise generators, can create a parametrically formulated noise signal, or sum of multiple individual parametrically formulated noise signals, which can be shaped across the acoustical frequency spectrum, or shaped across a portion of the acoustical frequency spectrum, to correlate generally to the threshold of hearing of an individual across the frequency spectrum or a portion of the frequency spectrum. For example, the average power spectrum amplitude of a parametrically formulated noise signal across the acoustical frequency spectrum, or a portion of the acoustical frequency spectrum, could be shaped to follow and/or fall just below an individual's threshold of hearing across the acoustical frequency spectrum, or portion of the acoustical frequency spectrum. Such a parametrically formulated noise signal would generally be inaudible to the individual, however, such a parametrically formulated noise signal would enable increased speech understanding and speech intelligibility when mixed with an audio signal containing speech or when mixed with speech sounds. The following formulas are instructive for selecting parameters for generating such a controlled and/or shaped noise signal:

The ratios of duration of the different periodic waves within a parametrically formulated noise signal are given by:

$$R_1 = (N_1 \times P_1)/((N_1 \times P_1) + (N_2 \times P_2) + \ldots + (N_N \times P_N))$$

$$R_2 = (N_2 \times P_2)/((N_1 \times P_1) + (N_2 \times P_2) + \ldots + (N_N \times P_N))$$

$$\ldots$$

$$R_N = (N_N \times P_N)/((N_1 \times P_1) + (N_2 \times P_2) + \ldots + (N_N \times P_N))$$

where:

$P_1$=360° period for the $1^{st}$ periodic wave=1/Frequency of the $1^{st}$ periodic wave;

$P_2$=360° period for the $2^{nd}$ periodic wave=1/Frequency of the $2^{nd}$ periodic wave;

$P_N$=360° period for the $N^{th}$ periodic wave=1/Frequency of the $N^{th}$ periodic wave;

$N_1$=Number of $1^{st}$ periodic waves per sequence;

$N_2$=Number of $2^{nd}$ periodic waves per sequence;

$N_N$=Number of $N^{th}$ periodic waves per sequence;

$R_1$=Ratio of duration for the $1^{st}$ periodic wave $R_2$=Ratio of duration for the $2^{nd}$ periodic wave $R_n$=Ratio of duration for the $N^{th}$ periodic wave The ratio of duration between any two periodic waves A and B ($R_{AB}$) is then given by: $R_{AB}=R_A/R_B$ The gain in dB for the power spectrum amplitude of the noise signal between any two frequencies A and B ($G_{AB}$) where frequency A corresponds to the frequency of a periodic wave A (1/period of periodic wave A), and frequency B corresponds to the frequency of a periodic wave B (1/period of periodic wave B), would then generally be given by: $G_{AB}=20\times\log_{in}(R_A/R_B)$ Those skilled in the art will realize, according to the embodiments described herein, that the power spectrum amplitude levels of the parametrically formulated noise signal can be controlled to be a function of frequency and can be designed by using different ratios of duration for the various periodic waves used. Those skilled in the art will realize that the examples and embodiments presented herein are illustrative for simplicity sake and are not necessarily optimized. Furthermore, according to various embodiments, other methods of randomization or pseudorandomization can be used to weight or distribute the probability of occurrence of each periodic wave such that the desired ratio of duration for each periodic wave within a noise signal can be selected, controlled, or influenced.

Embodiments utilizing such techniques may not need to have different numbers of periodic waves per sequence for each periodic wave imposed. According to an embodiment, techniques such as error diffusion could be used. Additionally, those skilled in the art will realize that there are many possible sampling frequencies or sampling periods that may be used with corresponding periodic waves and frequencies that may be designed to meet the criteria to create suitable parametrically formulated noise.

FIG. 4 illustrates a power spectrum graph 400 of a parametrically formulated noise signal. According to the present embodiment, power spectrum graph 400 illustrates the power level or amplitude 420 of a parametrically formulated noise signal similar to parametrically formulated noise signal 310 (see FIG. 3), as a function of frequency 430. Amplitude 420 is marked in 3 dB increments per a division 422. Frequency 430 is presented logarithmically from 100 Hz, noted at 432, to 9000 Hz, noted at 434. Parametrically formulated noise signal 310 was generated to be substantially within a range of two frequencies, for example between 2000 Hz, noted at 440, and 2462 Hz, noted at 442. The duration of the noise signal used to generate power spectrum graph 400 was about 3 seconds. As discussed for FIG. 3, power spectrum graph 400 demonstrates parametrically formulated noise where average power spectrum amplitude values within a range of frequencies are formulated as a function of the ratios of duration of the periodic waves used to generate the noise signal. According to the present embodiment, the power spectrum amplitude values were designed to be about 0.7 dB louder at 2462 Hz noted at 442, than at 2000 Hz noted at 440. Between 2000 Hz and 2462 Hz a plateau 450 is formed. The amplitude values on plateau 450 do not vary substantially above or below the amplitude values at 440 or 442. As shown amplitude values between amplitude 2000 Hz and 2462 Hz vary by less than about +/−1 dB. 1 dB variations in volume levels are generally below human perception.

Additional techniques, according to various embodiments, could be used to further flatten plateau 450. For example, a narrower frequency band could be used (e.g. a frequency band from 2000 Hz to 2370 Hz). Inclusion of additional periodic waves within the noise signal or modification of the relative ratios of duration may also be used to control or flatten plateau 450. Furthermore, other randomization techniques, for example techniques similar to error diffusion, could be used to uniformly distribute the occurrences of each periodic wave over time and thus control or flatten plateau 450.

FIG. 4, as well as FIGS. 8-11, were generated using a parametrically formulated noise generator similar to parametrically formulated noise generator 100 (see FIG. 1). In order to record the power spectrum of the noise signal generated, a parametrically formulated noise generator was coupled to a digital-to-analog converter (DAC), which was coupled to a personal computer via an analog-to-digital converter (ADC). Power spectrum analyzer software loaded onto the personal computer was used to generate the FIGS. 4, and 8-11. Various groups of minimal artifacts can be observed in FIGS. 4 and 8-11, including for example, a group of minimal artifacts 460, 462, 464, 466 in FIG. 4. These minimal artifacts are the result of various set-up conditions including: sampling quantization and intermodulation products of the periodic wave sampling frequency (16000 Hz in this example); the personal computer sampling frequency (44100 Hz in this example); nonlinearities in the DAC and the personal computer's ADC; the processor clock of the parametrically formulated noise generator not being synchronized with the personal computers clock; and other nonlinearities in the set-up conditions. Even so, minimal artifact 460, as shown, is 17 dB below the power spectrum amplitude at 2462 Hz noted at 442. Minimal artifact 462 is about 16 dB below the power spectrum amplitude at 2000 Hz noted at 440. Minimal artifact 464 is about 27 dB below the power spectrum amplitude at 2462 Hz noted at 442.

Minimal artifact 466 is about 33 dB below the power spectrum amplitude at 2000 Hz noted at 440. Other minimal artifacts which are not labeled are even lower in amplitude. All of the minimal artifacts are quiet enough so as to be imperceptible or unnoticed by a listener. Furthermore, the minimal artifacts would be reduced in any embodiment of a parametrically formulated noise generator which does not include one or more of the above described set-up conditions or nonlinearities. According to an embodiment, an audio system or device comprising a parametrically formulated noise generator would not include one or more of the nonlinearities described above.

FIGS. 5A-5F are a computer program listing according to various embodiments. The computer program listing can be executed to generate parametrically formulated noise. Within the computer program listing, two methods are presented: Method 1 and Method 2. These methods are not intended to be limiting but are intended to be instructive to the designer or manufacturer of an audio system or audio device which uses or generates parametrically formulated noise. The methods illustrate the generation of parametrically formulated noise in a relatively short time period. The methods comprise generating a time ordered, random or pseudorandom, sequence of periodically sampled periodic waves. Each of the methods can use two or more periodic waves having different frequencies which are represented by values corresponding to periodically sampled amplitudes of the periodic waves over a period of time. The methods can time order the different periodic waves so that they are random or appear random such that the parametrically generated noise, if it were heard, can be perceived as noise. The methods can employ transitions between the periodically sampled periodic waves such that the parametrically generated noise, if it were heard, can be heard as continuous. The ratios of duration of each of the periodic waves can be selected according to the sampling duration or period of each of the periodic waves. The computer program listing is a "C" computer program listing.

Method 1 (see lines [01] to [72] of FIG. 5) was implemented via parametrically formulated noise generator 100 (see FIG. 1) to produce parametrically formulated noise signal 310 (see FIG. 3). Method 1 can be configured to generate a parametrically formulated noise signal substantially within a first range of frequencies. According to an embodiment, a lookup table (see lines [23] to [34] of FIG. 5) can be generated or initialized to comprise a first series of values representing the amplitude of a 2000 Hz periodic wave sampled over three full periods and a second series of values representing the amplitude of a 2462 Hz periodic wave sampled over four full periods. According to an embodiment, the first series of values and the second series of values represent values sampled at a 16,000 Hz sampling rate. According to an embodiment, the first series of values and the second series of values are signed 24-bit values. According to alternative embodiments, lookup tables can be designed for any sampling rate or bit resolution. The values used within the computer program listing can be predetermined and/or preset within the computer program listing, or can be calculated and/or generated by the processor, or can be set and/or adjusted by a programmer or a user of a parametrically formulated noise generator. According to an embodiment the values used within the computer program listing can be amplified or attenuated via the use of fractional multiplication. According to various embodiments, Method 1 of the computer program listing can be configured to read out at a predetermined rate, the amplitude values of a noise signal by recursively selecting, randomly or pseudorandomly, between the first series of values or the second series of values and then reading out the selected series of values until a stop condition is met. According to an embodiment, additional series of values representing additional periodic waves can be generated and/or initialized into the lookup table. According to an embodiment, each series of values stored in the lookup table can be determined such that a continuous output can be created. For example, the first value of the first series of values can be the same value as the first value of the second series of values, and can represent an amplitude value where a periodic wave has a zero slope. Furthermore, the last value of the first series of values and the last value of the second series of values can represent the amplitude of their respective periodic waves at a sampling point immediately preceding the sampling point of the first value of the first series or the sampling point of the first value of the second series respectively (see lookup table values used in FIG. 5 for an example).

Method 2 (see lines [01] to [21] and lines [73] to [149]) represents a computer program listing that can be used by a parametrically formulated noise generator 100 (see FIG. 100) to generate a parametrically formulated noise signal. Method 2 can be configured to generate a parametrically formulated noise signal substantially within a selected range of frequencies. According to an embodiment, a lookup table (see lines [73] to [93] of FIG. 5) can be generated or initialized to comprise a first series of values representing the amplitude of a 4000 Hz periodic wave sampled over three full periods, a second series of values representing the amplitude of a 4740 Hz periodic wave sampled over four full periods, a third series of values representing the amplitude of a 5120 Hz periodic wave sampled over four full periods, and a fourth series of values representing the amplitude of a 5818 Hz periodic wave sampled over four full periods. According to an embodiment, each of the periodic waves is sampled at a 32,000 Hz sampling rate. According to an embodiment, the first, second, third, and fourth series of values are signed 16-bit values. According to alternative embodiments, lookup tables can be designed for any sampling rate or bit resolution. The values used within the computer program listing can be predetermined and/or preset within the computer program listing, or can be calculated and/or generated by the processor, or set and/or adjusted by a programmer or a user of a parametrically formulated noise generator. According to an embodiment the values used within the computer program listing can be amplified or attenuated via the use of fractional multiplication. According to various embodiments, Method 2 of the computer program listing is configured to implement two or more instances of Method 1 and sum the values read out by each instance of Method 1 and then read out the sum. For example, Method 2 of the computer program listing can be configured to select, randomly or pseudorandomly, between the first series of values or the second series of values, then select, randomly or pseudorandomly, between the third series of values or the fourth series of values, then read or obtain a first value from each of the selected series, and then sum the obtained first values and read out the sum value. The read out can continue repeatedly until a stop condition is met, for example, when the end of a series of values is encountered. This method can be repeated by making new random selections of series of values. According to an embodiment, additional series of values representing additional periodic waves can be generated and/or initialized into the lookup table. Furthermore, Method 2 can implement a plurality of instances of Method 1. According to an embodiment, each series of values stored in the lookup table can be determined such that a continuous output can be created. For example, the first value of each series of values can be the same value and can represent an amplitude value where a periodic wave has a zero slope. Furthermore, the last value of each series of values can represent the amplitude of their respective periodic waves at a sampling point immediately preceding the sampling point of the first value of the series (see lookup table values used in FIG. 5 for an example).

According to an embodiment, Method 2 can be configured to generate a noise signal comprising the summation of 12 different instances of Method 1 or 12 different instances of parametrically formulated noise generators. For example, Method 1 can be instantiated for 12 different frequency ranges: (a) 400 to 471 Hz; (b) 500 to 604 Hz; (c) 627 to 762 Hz; (d) 800 to 942 Hz; (e) 1000 to 1230 Hz; (f) 1280 to 1524 Hz; (g) 1600 to 1882 Hz; (h) 2000 to 2370 Hz; (i) 2560 to 2910 Hz; (j) 3200 to 3764 Hz; (k) 4000 to 4740 Hz; and, (l) 5120 to 5818 Hz. Various levels of fractional multiplication can be applied to the elements or values within the lookup tables for the 12 different frequency ranges or within each of the series of values within each instance of Method 1. Once a value is produced by each of the 12 instances of Method 1, the 12 values can be summed and the sum value can be read out.

Those skilled in the art will appreciate that many different techniques can be used for selecting and/or generating or initializing the values within lookup table(s), modifying the values within lookup table(s), randomizing the selection of each series of values, etc. without departing from the scope of the invention described herein. Many unique configurations can result as design decisions are made to balance performance, cost, and complexity of an audio system utilizing parametrically formulated noise.

Figure 6:
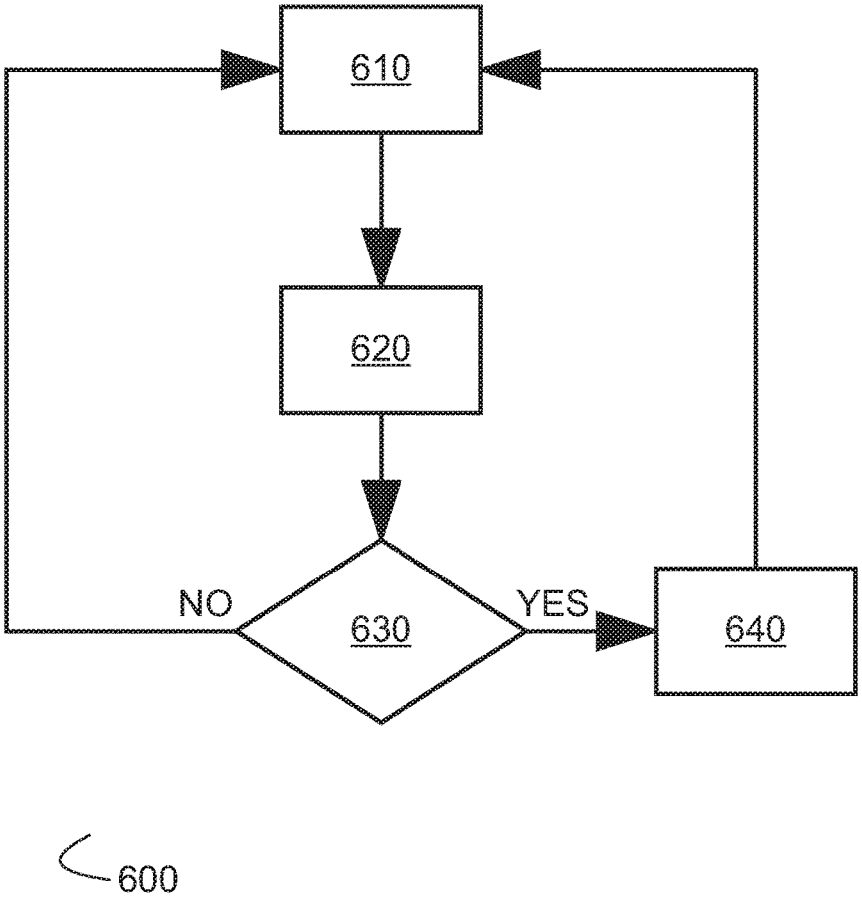
FIG. 6 illustrates a flow chart of a method in accordance with an embodiment of the present invention.

FIG. 6 illustrates a flow chart for a method 600 for generating values corresponding to parametrically formulated noise. According to an embodiment, method 600 can be implemented using a parametrically formulated noise generator, for example, parametrically formulated noise generator 100 (see FIG. 1). A parametrically formulated noise generator can comprise a processor and a storage device. The storage device can store one or more lookup tables. The lookup tables can store values representing the amplitude of a periodic wave, or a plurality of periodic waves, sampled over time. Each of the plurality of periodic waves can be sampled at a sampling rate over a sampling period of time which may be less than one period of the periodic wave, equal to one period of the periodic wave, or longer than one period of the periodic wave. For example, the lookup table may store a first set of values representing the amplitude of a first periodic wave sampled at 16,000 Hz over a time period equivalent to about 3 periods of first periodic wave. The sampling rate, the length of the sampling period, and the frequency or period of the periodic waves stored in lookup tables can be varied and modified according to the design of the parametrically formulated noise generator as previously described. Furthermore, the parametrically formulated noise generator may employ varied randomization or pseudorandomization techniques according to the design of parametrically formulated noise generator as previously described.

According to an embodiment, in step 640, a parametrically formulated noise generator can randomly or pseudorandomly select a periodic wave from the plurality of periodic waves. In step 610, a parametrically formulated noise generator can read a first value from a set of values corresponding to the amplitude values of the selected periodic wave. In step 620, a parametrically formulated noise generator can write the value to an output. In step 630, a parametrically formulated noise generator can determine whether or not all values from the set of values for the selected periodic wave have been written to the output. If NO, a parametrically formulated noise generator can proceed to step 610 and read the next value representing the next amplitude value of the selected periodic wave. If YES, a parametrically formulated noise generator can proceed to step 640 and randomly or pseudorandomly select a periodic wave from the plurality of periodic waves.

According to an embodiment, one or more of the steps of method 600 can be performed in parallel by multiple instances of parametrically formulated noise generators. According to an embodiment, one or more of the steps of method 600 can be recursively performed for different periodic waves before proceeding to another step.

According to an embodiment, in step 640, a parametrically formulated noise generator can randomly or pseudorandomly select one or more periodic waves from the plurality of periodic waves. In step 610, a parametrically formulated noise generator can read a value from each set of values corresponding to the amplitude values of each of the selected periodic waves and generate a sum of the read values. In step 620, a parametrically formulated noise generator can write the value of the sum to an output. In step 630, a parametrically formulated noise generator can determine whether or not all values from the set of values for any of the selected periodic waves have been written to the output. If NO, a parametrically formulated noise generator can proceed to step 610 and read the next values representing the next amplitude values of the selected periodic waves. If YES, a parametrically formulated noise generator can proceed to step 640 and randomly or pseudorandomly select one or more periodic waves from the plurality of periodic waves.

It is not intended that method 600 begin with any specific step. For example, method 600 may be performed by a parametrically formulated noise generator beginning with step 640, or alternatively, method 600 may be performed by a parametrically formulated noise generator beginning with step 610. It is not intended that the steps of method 600 be restricted to an exact order or that they be practiced or performed in a sequential manner over a period of time. For example, one or more of steps 610, 620, 630, and 640 can be performed concurrently or partially overlapping in time. Furthermore, according to an embodiment, one or more of steps 610, 620, 630, and 640 may be performed one or more times recursively before proceeding to a next step.

Figure 7:
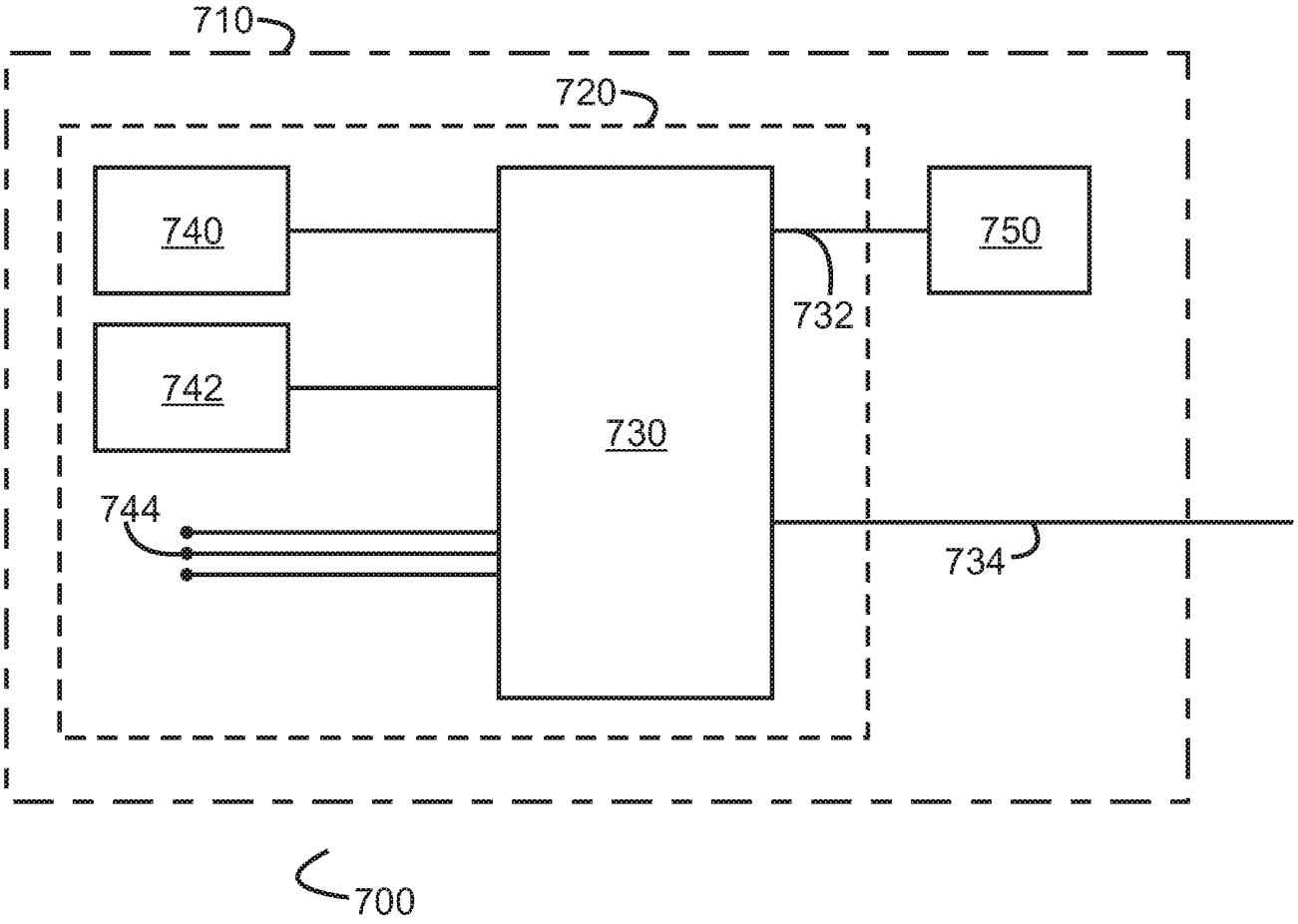
FIG. 7 illustrates a schematic diagram of an audio system in accordance with an embodiment of the present invention.

FIG. 7 illustrates a schematic diagram 700 of an audio system 710. According to an embodiment, audio system 710 can include a parametrically formulated noise generator 720 and a user input 750. According to an embodiment, parametrically formulated noise generator 720 can comprise a processor 730 and a storage device (not shown) for storing one or more lookup tables or sets of values 740, 742, and, if applicable, one or more additional lookup tables or sets of values 744. Each of the sets of values can comprise one or more subsets of values, each of which can correspond to values representing the amplitude of a periodic wave sampled at a sampling rate over an amount or period of time. According to an embodiment, various sets of values or subsets of values can represent one or more different periodic waves each having a different period or frequency.

According to an embodiment, user input 750 can be an input configured to allow a user to adjust, modify or reset the values stored in each of lookup tables, sets of values, or subsets of values. According to another embodiment, user input 750 can be a volume control configured to allow the user to increase or decrease the volume of the parametrically formulated noise signal generated by parametrically formulated noise generator 720. According to another embodiment, user input 750 can be an input configured to allow user to respond to hearing tests generated by audio system 710, wherein the user's responses can be used to determine the values stored in one or more of lookup tables 740, 742, and 744.

Parametrically formulated noise generator 720 is configured to generate and output a parametrically formulated noise signal 734. According to an embodiment, parametrically formulated noise signal 734 may comprise the sum of individual values obtained from lookup tables 740, 742, and 744. According to an embodiment, each of the values obtained from 740, 742, and 744 can represent the amplitude of a periodic wave within a particular selected range of frequencies. For example, the values obtained from lookup tables 740, 742, and 744 can represent the amplitude of a periodic wave within one of the following twelve selected ranges of frequencies: (a) 400 to 471 Hz; (b) 500 to 604 Hz; (c) 627 to 762 Hz; (d) 800 to 942 Hz; (e) 1000 to 1230 Hz; (f) 1280 to 1524 Hz; (g) 1600 to 1882 Hz; (h) 2000 to 2370 Hz; (i) 2560 to 2910 Hz; (j) 3200 to 3764 Hz; (k) 4000 to 4740 Hz; and, (l) 5120 to 5818 Hz. According to an embodiment, each of the twelve values obtained from lookup tables 740, 742, and 744 can be generated simultaneously or serially. According to an embodiment, a first value from each of the twelve lookup tables 740, 742, and 744 can be obtained serially or in parallel, and summed before proceeding to obtain a second value from each of the twelve lookup tables 740, 742, and 744. According to an embodiment, each of the twelve first values can be added together and the sum of each of the twelve first values can correspond to the first value to be output by parametrically formulated noise generator 720. Next, each of the twelve second values can be added together and the sum of each of the twelve second values can correspond to the second value to be output by parametrically formulated noise generator 720. This process can continue repeatedly until a stop condition is met. According to an embodiment, the power spectrum of each of the quasi-signals (represented by the various streams of values obtained by processor 730 from each of the twelve lookup tables) can be controlled and/or shaped to correlate to the threshold of hearing of an individual across each of the related frequency ranges. According to one embodiment, the average power spectrum amplitude of parametrically formulated noise signal 734 across the acoustical frequency spectrum, or a portion of the acoustical frequency spectrum, can be controlled and/or shaped to follow or fall just below an individual's threshold of hearing across the acoustical frequency spectrum, or across a portion of the acoustical frequency spectrum.

According to an embodiment, parametrically formulated noise signal 734 can be outputted from parametrically formulated noise generator 720 to a digital-to-analog converter (DAC). According to an embodiment, a DAC can be configured as part of processor 730 or part of the same chip or chipset as processor 730. According to an embodiment, a DAC can be a standalone device or form part of a separate chip. According to an embodiment, a DAC can be configured to convert parametrically formulated noise signal 734 into an analog equivalent signal. Those skilled in the art will recognize that the analog equivalent signal output from a DAC may be take various forms, including: an analog voltage signal; an analog current signal; a sigma-delta modulator signal used to produce a pulse density modulated (PDM) output signal; a pulse-code modulated (PCM) output signal; a pulse-width modulated (PWM) output signal; a differential pulse-code modulated (DPCM) output signal; an adaptive delta modulated (ADM) output signal; a digital representation of an analog signal, etc.

Figure 8:
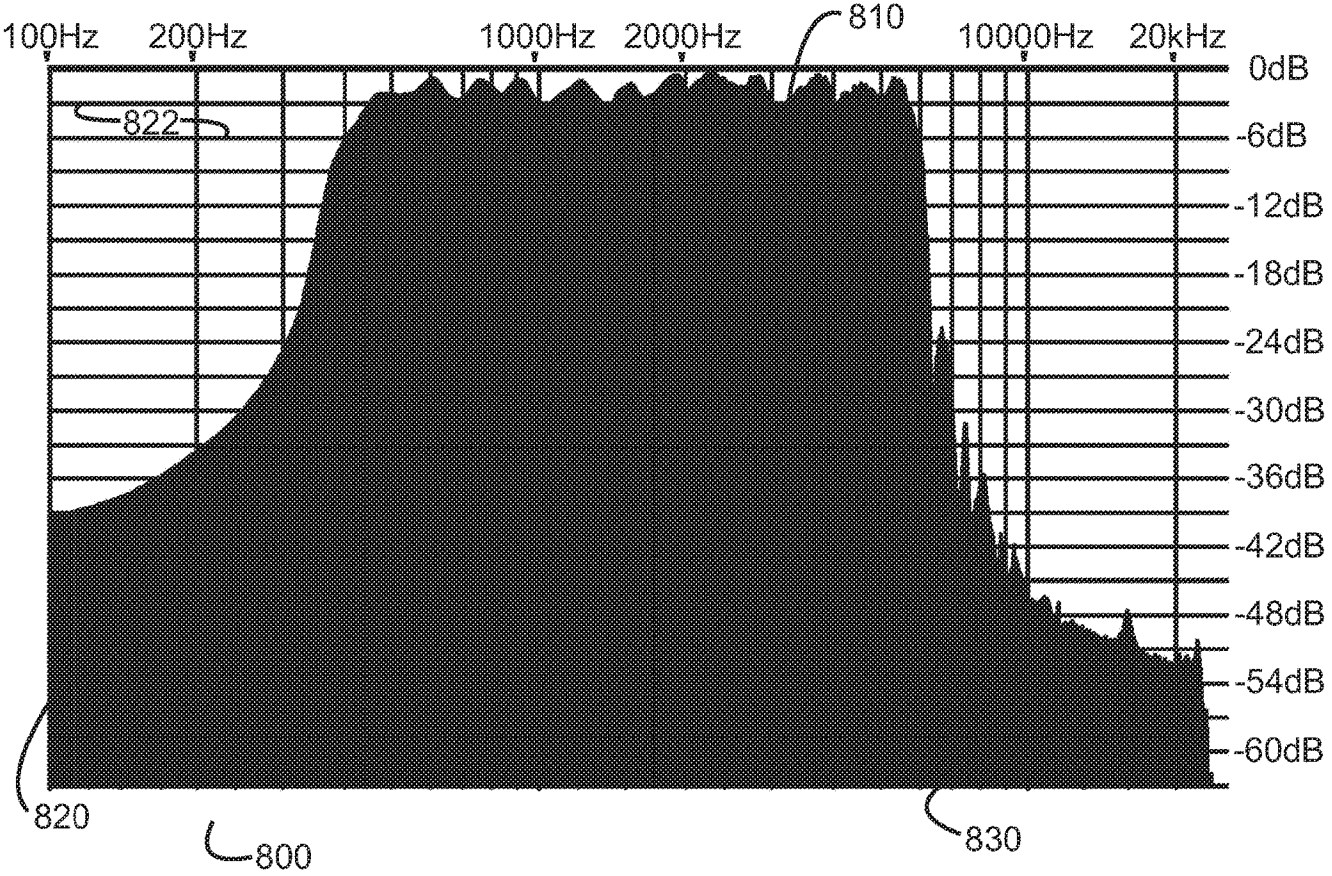
FIG. 8 illustrates a power spectrum graph of a parametrically formulated noise signal in accordance with an embodiment of the present invention.

FIG. 8 illustrates a power spectrum graph 800 of a parametrically formulated noise signal according to an embodiment. Power spectrum graph 800 illustrates a power level or amplitude 820 of a parametrically formulated noise signal as a function of frequency 830. According to an embodiment, power spectrum graph 800 illustrates the amplitude 820 of a parametrically formulated noise generated by parametrically formulated noise generator 720 (see FIG. 7). Amplitude 820 is marked in 3 dB increments per division 822. Frequency 830 is presented logarithmically from 100 Hz to about 20000 Hz. The parametrically formulated noise signal used to generate power spectrum graph 800 was generated and configured to be substantially within a range of frequencies between about 450 Hz and 5818 Hz. According to an embodiment, values or parameters representing or controlling of the ratio of duration of various periodic waves were used to generate a parametrically formulated noise signal which would plateau or be substantially flat between about 450 Hz and 5818 Hz. As shown, between about 450 Hz and 5818 Hz, a plateau 810 is formed. By design, the amplitude values between about 450 Hz and 5818 Hz do not vary substantially above or below the amplitude values at 450 Hz or at 5818 Hz. As shown amplitude values between about 450 Hz and 5818 Hz vary by less than about +/−1 dB. According to an embodiment, fractional multiplication of the sets of values 740, 742, and 744 (see FIG. 7) was used to adjust the output level of each of the values obtained by processor 730 from lookup tables 740, 742, and 744 in order to obtain plateau 810.

Figure 9:
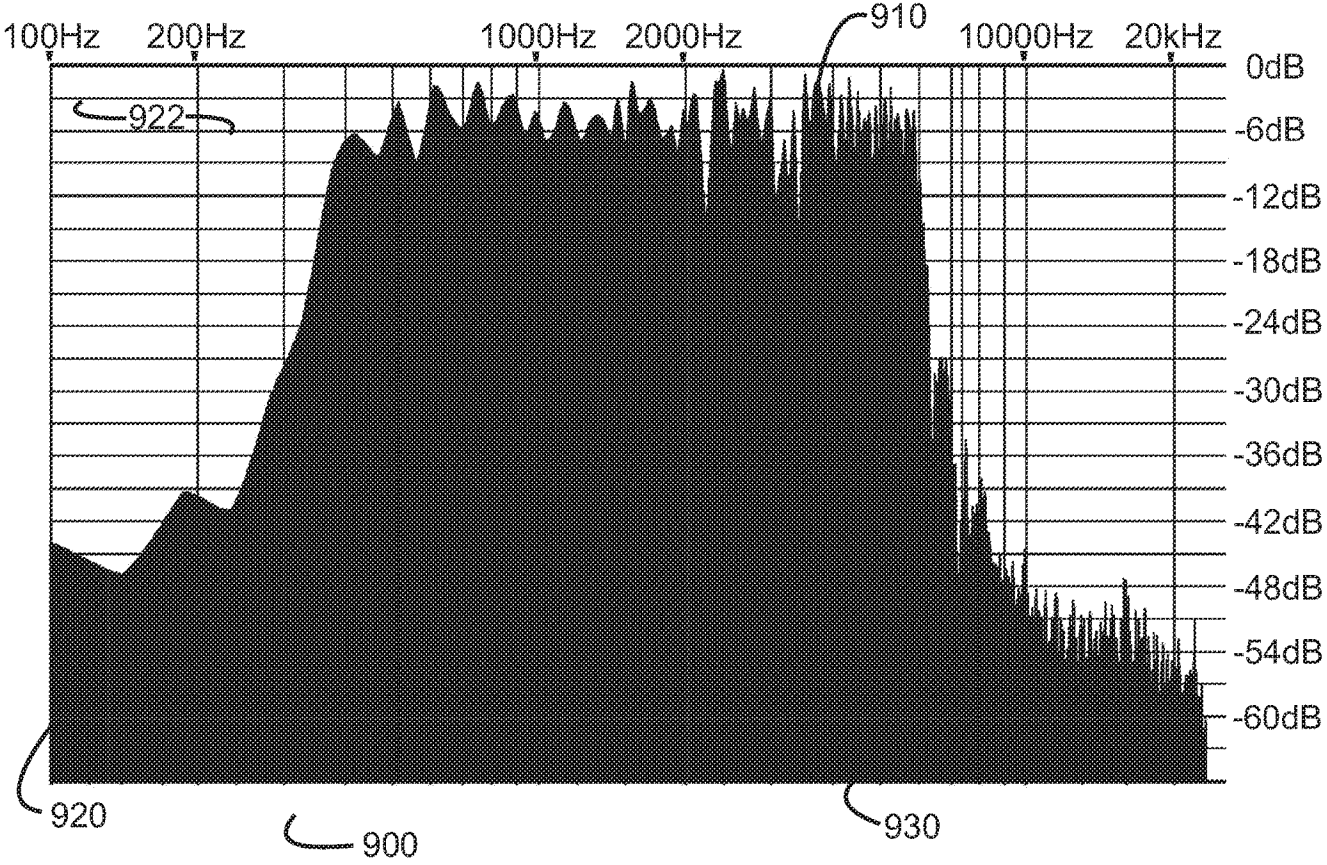
FIG. 9 illustrates a power spectrum graph of a parametrically formulated noise signal in accordance with an embodiment of the present invention.

FIG. 9 illustrates a power spectrum graph 900 of a parametrically formulated noise signal according to an embodiment. Power spectrum graph 900 illustrates a power level or amplitude 920 of a parametrically formulated noise signal as a function of frequency 930. According to an embodiment, power spectrum graph 900 illustrates the amplitude 920 of a parametrically formulated noise generated by parametrically formulated noise generator 720 (see FIG. 7) as a function of frequency 930. Amplitude 920 is marked in 3 dB increments per division 922. Frequency 930 is presented logarithmically from 100 Hz to about 20000 Hz. The parametrically formulated noise signal used to generate power spectrum graph 900 was the same signal used to generate power spectrum graph 800 (see FIG. 8), however, power spectrum graph 900 was generated using only a 50 millisecond length of the parametrically formulated noise signal. The parametrically formulated noise signal was generated and configured to be substantially within a range of frequencies between about 450 Hz and 5818 Hz.

According to an embodiment, values or parameters representing or controlling of the ratio of duration of various periodic waves were set or selected to generate a parametrically formulated noise signal which would plateau or be substantially flat between about 450 Hz and 5818 Hz. As shown, between about 450 Hz and 5818 Hz, a plateau 910 is formed. By design, the amplitude values between about 450 Hz and 5818 Hz do not vary substantially above or below the amplitude values at 450 Hz or at 5818 Hz. Accordingly, parametrically formulated noise according to an embodiment, can quickly (e.g. in less than 50 milliseconds) generate parametrically formulated noise signal filling a wide frequency range.

Figure 10:
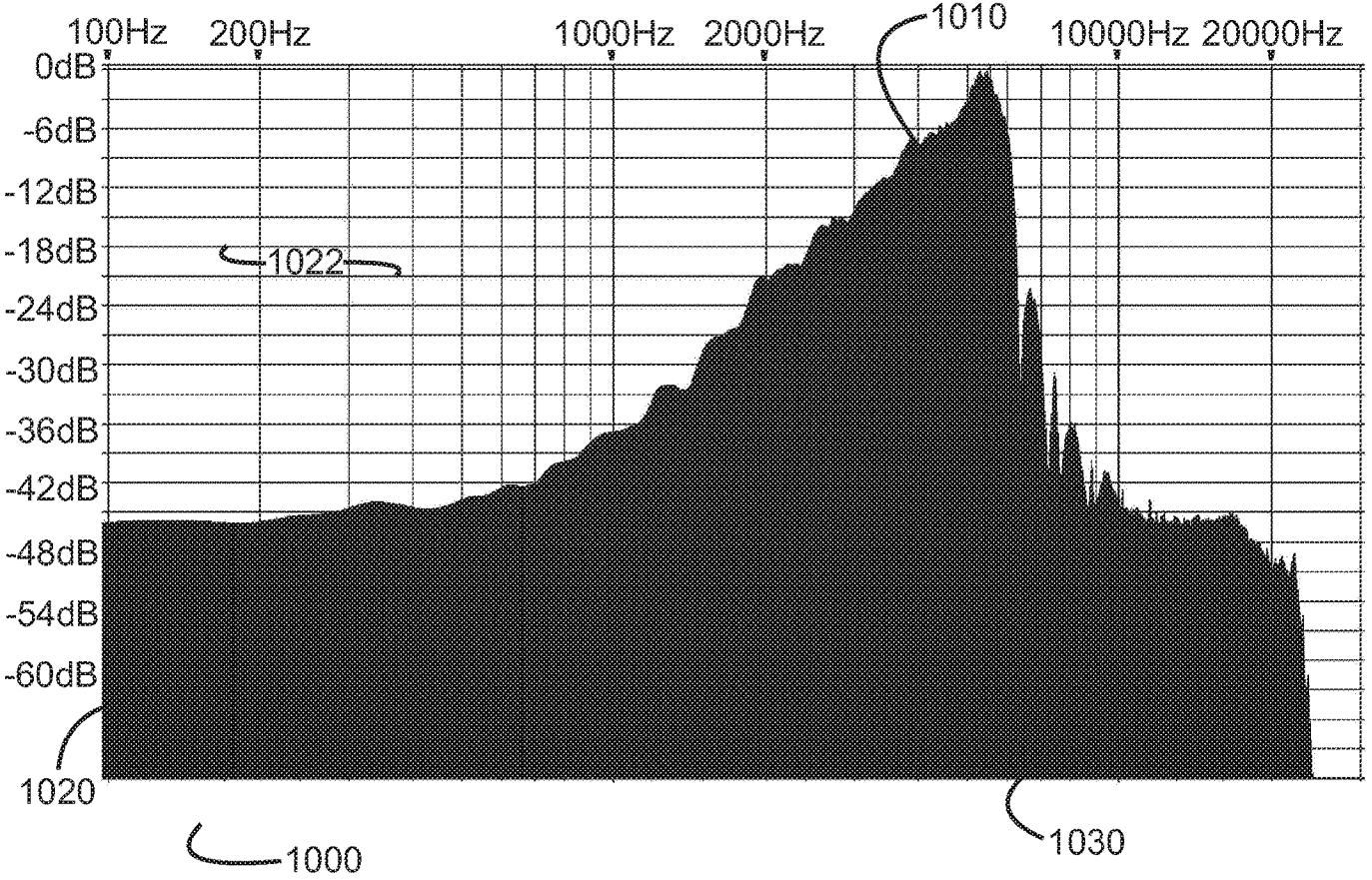
FIG. 10 illustrates a power spectrum graph of a parametrically formulated noise signal in accordance with an embodiment of the present invention.

FIG. 10 illustrates a power spectrum graph 1000 of a parametrically formulated noise signal according to an embodiment. Power spectrum graph 1000 illustrates a power level or amplitude 1020 of a parametrically formulated noise signal as a function of frequency 1030. According to an embodiment, power spectrum graph 1000 illustrates the amplitude 1020 of a parametrically formulated noise generated by parametrically formulated noise generator 720 (see FIG. 7) as a function of frequency 1030. Amplitude 1020 is marked in 3 dB increments per division 1022. Frequency 1030 is presented logarithmically from 100 Hz to about 20000 Hz. According to an embodiment, values or parameters representing or controlling of the ratio of duration of various periodic waves were used to generate a parametrically formulated noise signal which would have the power spectrum characteristics shown by power spectrum graph 1000. Specifically, a parametrically formulated noise signal was designed which would have an increasing power spectrum amplitude slope between about 450 Hz to about 5818 Hz. As shown, power spectrum amplitude 1020 has such an increasing slope between about 450 Hz and 5818 Hz.

Figure 11:
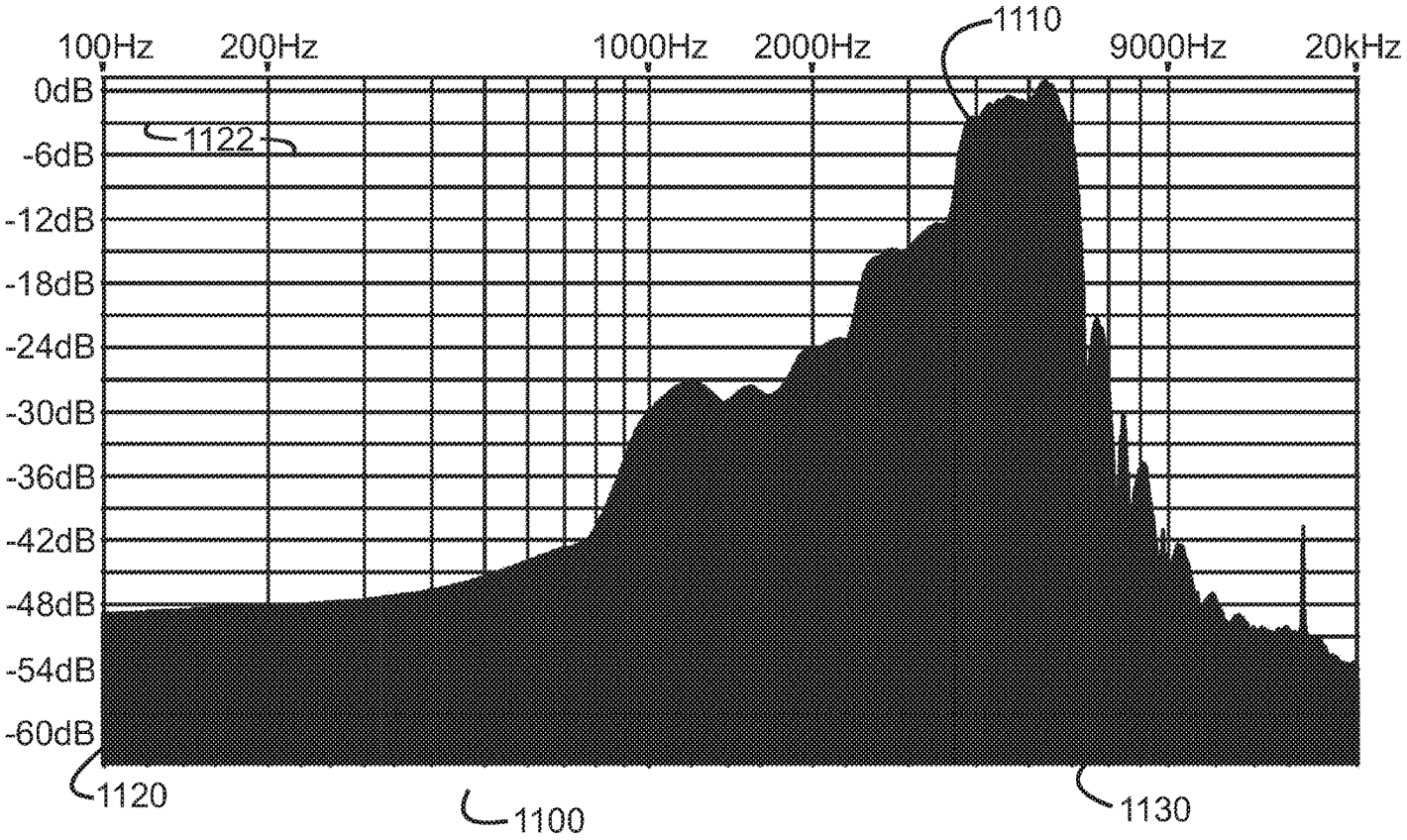
FIG. 11 illustrates a power spectrum graph of a parametrically formulated noise signal in accordance with an embodiment of the present invention.

FIG. 11 illustrates a power spectrum graph 1100 of a parametrically formulated noise signal according to an embodiment. Power spectrum graph 1100 illustrates a power level or amplitude 1120 of a parametrically formulated noise signal as a function of frequency 1130. According to an embodiment, power spectrum graph 1100 illustrates the amplitude 1120 of a parametrically formulated noise generated by parametrically formulated noise generator 720 (see FIG. 7) as a function of frequency 1130. Amplitude 1120 is marked in 3 dB increments per division 1122. Frequency 1130 is presented logarithmically from 100 Hz to about 20000 Hz. According to an embodiment, values or parameters representing or controlling of the ratio of duration of various periodic waves were used to generate a parametrically formulated noise signal which would have the power spectrum characteristics shown by power spectrum graph 1000. Specifically, a parametrically formulated noise signal was designed such that the power spectrum amplitude of the parametrically formulated noise signal would fall just below the thresholds of hearing for an individual across a frequency spectrum from about 450 Hz to about 5818 Hz. As shown, amplitude 1120 of a parametrically formulated noise signal has characteristics correlating to the hearing curve of an individual across a frequency spectrum from about 450 Hz to about 5818 Hz and stays just below the individual's threshold of hearing across the frequency spectrum from about 450 Hz to about 5818 Hz.

Figure 12:
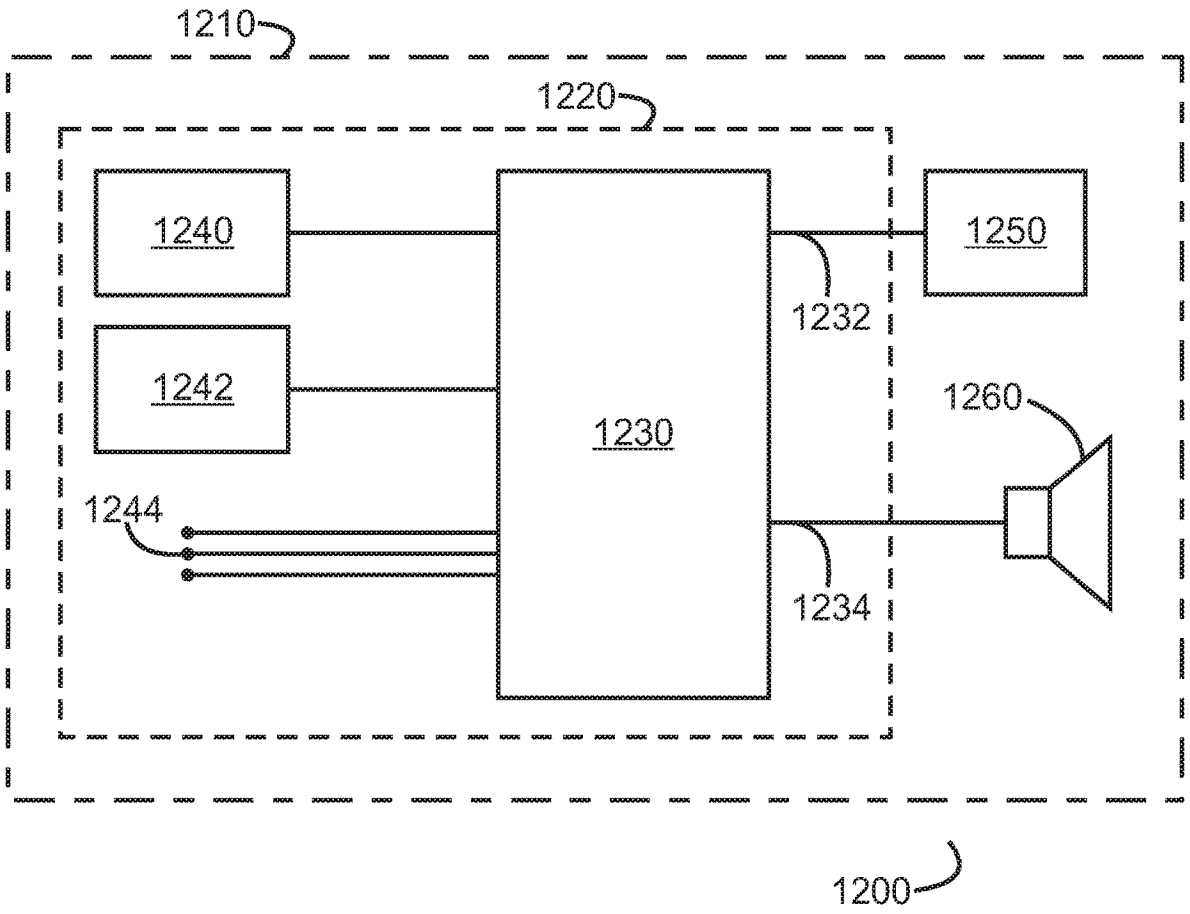
FIG. 12 illustrates a schematic diagram of an audio system in accordance with an embodiment of the present invention.

FIG. 12 illustrates a schematic diagram 1200 of an audio system 1210. According to an embodiment, audio system 1210 can include a parametrically formulated noise generator 1220, a user input 1250 and a receiver or speaker 1260. According to an embodiment, parametrically formulated noise generator 1220 can comprise a processor 1230 and a storage device (not shown) for storing one or more lookup tables or sets of values 1240, 1242, and, if applicable, one or more additional lookup tables or sets of values 1244. Each of the sets of values can comprise one or more subsets of values, each of which can correspond to values representing the amplitude of a periodic wave sampled at a sampling rate over an amount or period of time. According to an embodiment, various sets of values or subsets of values can represent one or more different periodic waves each having a different period or frequency.

According to an embodiment, user input 1250 can be an input configured to allow a user to adjust, modify or reset the values stored in each of lookup tables, sets of values, or subsets of values. According to another embodiment, user input 1250 can be a volume control configured to allow the user to increase or decrease the volume of the parametrically formulated noise signal generated by parametrically formulated noise generator 1220. According to another embodiment, user input 1250 can be an input configured to allow user to respond to hearing tests generated by audio system 1210, wherein the user's responses can be used to determine the values stored in one or more of lookup tables 1240, 1242, and 1244.

Parametrically formulated noise generator 120 is configured to generate and output a parametrically formulated noise signal 1234 via speaker 1260. According to an embodiment, parametrically formulated noise signal 1234 may comprise the sum of individual values obtained from lookup tables 1240, 1242, and 1244. According to an embodiment, each of the values obtained from 1240, 1242, and 1244 can represent the amplitude of a periodic wave within a particular selected range of frequencies. For example, the values obtained from lookup tables 1240, 1242, and 1244 can represent the amplitude of a periodic wave within one of the following twelve selected ranges of frequencies: (a) 400 to 471 Hz; (b) 500 to 604 Hz; (c) 627 to 762 Hz; (d) 800 to 942 Hz; (e) 1000 to 1230 Hz; (f) 1280 to 1524 Hz; (g) 1600 to 1882 Hz; (h) 2000 to 2370 Hz; (i) 2560 to 2910 Hz; (j) 3200 to 3764 Hz; (k) 4000 to 4740 Hz; and, (l) 5120 to 5818 Hz. According to an embodiment, each of the twelve values obtained from lookup tables 1240, 1242, and 1244 can be generated simultaneously or serially. According to an embodiment, a first value from each of the twelve lookup tables 1240, 1242, and 1244 can be obtained serially or in parallel, and summed before proceeding to obtain a second value from each of the twelve lookup tables 1240, 1242, and 1244. According to an embodiment, each of the twelve first values can be added together and the sum of each of the twelve first values can correspond to the first value to be output by parametrically formulated noise generator 1220. Next, each of the twelve second values can be added together and the sum of each of the twelve second values can correspond to the second value to be output by parametrically formulated noise generator 1220. This process can continue repeatedly until a stop condition is met. According to an embodiment, the power spectrum of each of the quasi-signals (represented by the various streams of values obtained by processor 1230 from each of the twelve lookup tables) can be controlled and/or shaped to correlate to the threshold of hearing of an individual across each of the related frequency ranges. According to one embodiment, the average power spectrum amplitude of parametrically formulated noise signal 1234 across the acoustical frequency spectrum, or a portion of the acoustical frequency spectrum, can be controlled and/or shaped to follow or fall just below an individual's threshold of hearing across the acoustical frequency spectrum, or across a portion of the acoustical frequency spectrum.

According to an embodiment, parametrically formulated noise signal 1234 can be outputted from parametrically formulated noise generator 1220 to a digital-to-analog converter (DAC) before being presented to speaker 1260. According to an embodiment, a DAC can be configured as part of processor 1230 or part of the same chip or chipset as processor 1230. According to an embodiment, a DAC can be a standalone device or form part of a separate chip. According to an embodiment, a DAC can be configured to convert parametrically formulated noise signal 1234 into an analog equivalent signal. Those skilled in the art will recognize that the analog equivalent signal output from a DAC may be take various forms, including: an analog voltage signal; an analog current signal; a sigma-delta modulator signal used to produce a pulse density modulated (PDM) output signal; a pulse-code modulated (PCM) output signal; a pulse-width modulated (PWM) output signal; a differential pulse-code modulated (DPCM) output signal; an adaptive delta modulated (ADM) output signal; a digital representation of an analog signal, etc.

Figure 13:
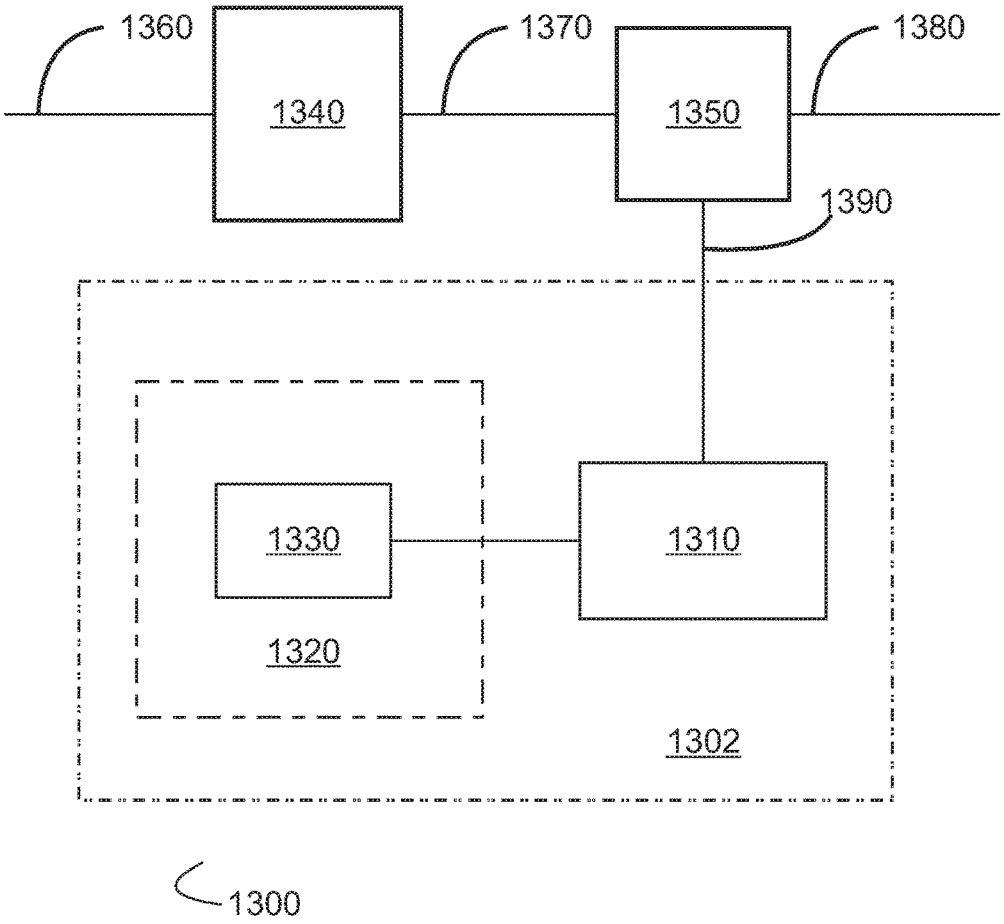
FIG. 13 illustrates a schematic diagram of an audio system in accordance with an embodiment of the present invention.

FIG. 13 illustrates a schematic diagram of an audio system 1300. Audio system 1300 comprises a parametrically formulated noise generator 1302, an amplifier or signal processor 1340, and a mixer 1350. According to various embodiments, parametrically formulated noise generator 1302 is configured to generate a parametrically formulated noise signal 1390. Parametrically formulated noise generator 1302 comprises a processor 1310 and a storage device 1320. Processor 1310 may be any type of computing processor capable of performing operations on data, for example, processor 1310 may be a microprocessor, a central processing unit ("CPU"), or a digital signal processor ("DSP"). Processor 1310 may also be a combination of two or more processors, for example, processor 1310 may comprise one or more processor cores or may comprise a CPU and a DSP. Processor 1310 may also be integrated within a larger component, chip, chipset, or system, for example, processor 1310 may form a part of a system on chip ("SoC"), a microcontroller, a computer, or any type of computing device. A lookup table or a plurality of lookup tables 1330 can be stored on storage device 1320. Storage device 1320 may comprise any type of computing or data storage device, memory, or medium, for example, storage device 1320 may comprise random access memory ("RAM"), read only memory ("ROM"), programmable read only memory ("PROM"), erasable programmable read only memory ("EPROM"), electrically erasable programmable read only memory ("EEPROM"), solid state storage, flash memory, hard disk storage, optical disk storage, or any and all types of non-volatile or volatile memory, or any combination of the foregoing.

According to an embodiment, processor 1310 can be coupled to storage device 1320. However, it is not a limitation that processor 1310 be directly coupled to storage device 1320 without any intervening elements, components, systems, or devices, nor is it a limitation that processor 1310 be hard-wired to storage device 1320. Those skilled in the art will recognize many ways to store and communicate information between processor 1310 and storage device 1320 including both wired and wireless configurations. Furthermore, according to an embodiment, processor 1310 and storage device 1320 can be integrated onto a single chip or chipset. According to an embodiment, processor 1310 and signal processor 1340 may comprise or be embodied by or on the same processor.

Processor 1310 can be programmed to generate a parametrically formulated noise signal. According to an embodiment, parametrically formulated noise generator 1302 can be configured according to any embodiment described or enabled herein. According to an embodiment, a parametrically formulated noise signal can comprise a time ordered, random or pseudorandom, sequence of periodic waves having frequencies substantially within a first range of frequencies. Processor 1310 can be configured to generate a parametrically formulated noise signal using values stored in lookup table 1330. Lookup table 1330 can store values corresponding to or representative of the amplitude of periodic waves having various frequencies, sampled at various sampling rates over various periods of time. For example, lookup table 1330 may store values corresponding to or representative of the amplitude of a 2000 cycles per second or Hertz ("Hz") first periodic wave (e.g. a cosine wave) sampled at 16,000 Hz over a period of about 0.0015 seconds. Additionally, lookup table 1330 may store values corresponding to or representative of the amplitude of a 2462 Hz second periodic wave (e.g. a cosine wave) sampled at 16,000 Hz over a period of about 0.001625 seconds. According to an embodiment, lookup table 1330 can be configured to store a virtually unlimited number of values corresponding or representative of periodic waves of various frequencies sampled at various sampling rates over various periods of time.

Furthermore, the values stored on lookup table 1330 may be changed according to the hearing loss or hearing needs of an individual as described hereinafter. The reasonable selection of frequencies, sampling rates, and sampling periods yielding values for storage in lookup table 1330 has been described above. According to various embodiments, processor 1310 can be programmed or configured to generate a noise signal utilizing values from lookup table 1330 stored on storage device 1320. The noise signal generated by parametrically formulated noise generator 1302 can be used with or as part of an audio device or audio system to improve speech understanding and speech intelligibility. Characteristics and parameters of the noise signal generated by parametrically formulated noise generator 1302 can be selected, changed, or modified based on the hearing ability or hearing loss of a user of the audio device or audio system, or based on the average hearing ability or hearing loss of a population.

According to an embodiment, signal processor 1340 can be configured to receive a first signal 1360 and generate a second signal 1370. First signal 1360 may be an audio signal. First signal 1360 may be either an analog signal or a digital signal. Those skilled in the art will appreciate that either analog signal processing or digital signal processing can be used without departing from the teachings of the specification. Typically, analog signals can be converted to digital signals through the use of an analog-to-digital converter (ADC). Furthermore, digital signals can be converted to analog signals through the use of a digital-to-analog converter (DAC). It is noted that ADCs and DACs can be implemented throughout any embodiment described or enabled herein in order to convert signals from one type to another. Methods and devices for ADC and DAC are known to those skilled in the art. According to the present embodiment, first signal 1360 represents a digital audio signal containing speech information. Signal processor 1340 can be configured to generate second signal 1370 which can correspond to a processed or amplified first signal 1360. According to an embodiment, amplifier or digital signal processor can amplify first signal 1360 or portions of first signal 1360 according to known digital signal processing techniques. For example, signal processor 1340 can be configured to amplify one or more frequencies or frequency ranges of first signal 1360 according to a fitting protocol or prescription, apply wide dynamic range compression (WDRC) techniques, and/or apply automatic gain control (AGC) techniques. Mixer 1350 is configured to receive second signal 1370 from signal processor 1340 and receive parametrically formulated noise signal 1390 from processor 1310 and generate a summation signal representing the sum of second signal 1370 and parametrically formulated noise signal 1390.

According to an embodiment, audio system 1300 can be implemented within any type of hearing aid. According to an embodiment, summation signal 1380 can represent an audio signal having improved speech intelligibility.

Figure 14:
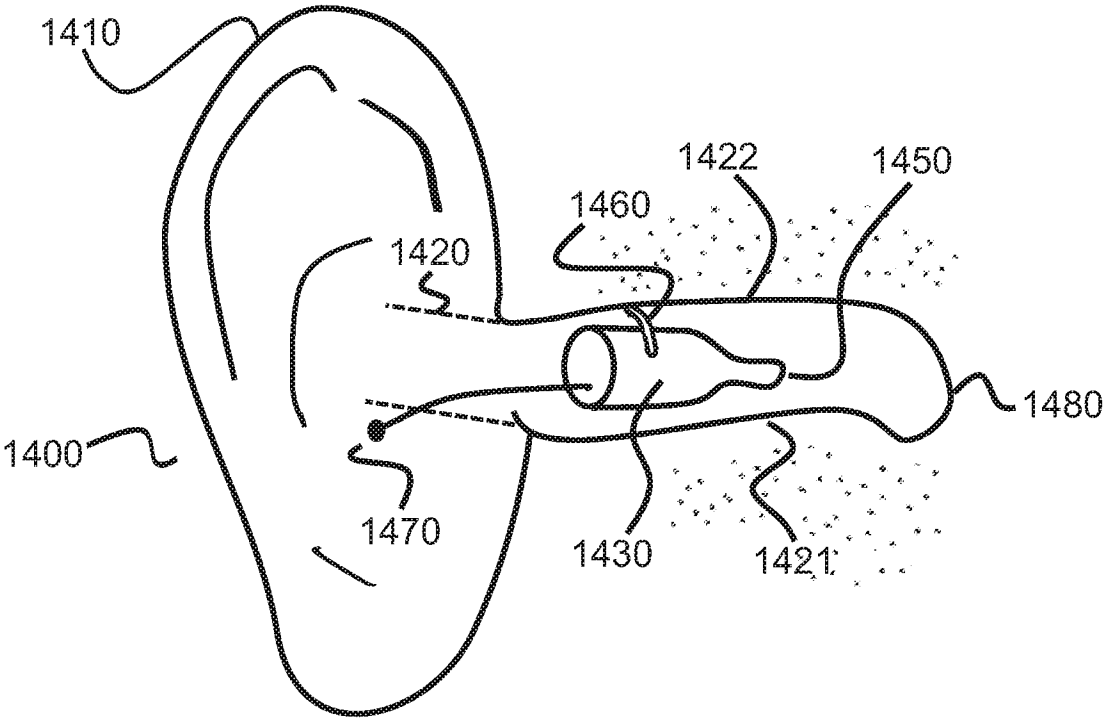
FIG. 14 illustrates a hearing aid in accordance with an embodiment of the present invention.

FIG. 14 illustrates a hearing aid 1430 within an ear 1400. Hearing aid 1430 may be any type of hearing aid including an in-the-ear (ITE) hearing aid, an in-the-canal (ITC) hearing aid, a completely-in-canal (CIC) hearing aid, an invisible-in-canal (IIC) hearing aid, a receiver-in-canal hearing aid (RIC), a behind-the-ear hearing aid (BTE), or any other type of hearing aid known to those skilled in the art. Ear 1400 includes a pinna 1410 and an ear canal 1420. According to an embodiment, hearing aid 1430 or a portion of hearing aid 1430 can be inserted in ear canal 1420. According to an embodiment, all of hearing aid 1430 or a portion of hearing aid 1430 can be smaller than ear canal 1420. According to an embodiment, a portion of hearing aid 1430 can make contact to at least one point along the ear surface 1421 and/or ear surface 1422 of ear canal 1420. According to an embodiment, hearing aid 1430 can have a speaker or receiver 1450. According to an embodiment, the output of receiver 1450 can be directed towards the tympanic membrane 1480. According to an embodiment, a retaining or support device 1460 can be used to keep hearing aid 1430 or a portion of hearing aid 1430 from falling out of ear canal 1420. According to an embodiment, a removal stem 1470 may be used to extract hearing aid 1430 or a portion of hearing aid 1430 from the ear canal 1420. In the presence of sound, air conduction sound can be focused by pinna 1410 into the ear canal 1420. According to an embodiment, sound can follow the ear canal 1420 to the tympanic membrane 1480 as, according to an embodiment, hearing aid 1430 may be non-occluding and can allow sound to pass around hearing aid 1430. According to an embodiment, hearing aid 1430 may not include all of the elements or features described in the above description of hearing aid 1430. Furthermore, according to an embodiment, hearing aid 1430 may comprise additional elements not described above but typical of one or more types of hearing aid. According to an embodiment, hearing aid 1430 may comprise other types of hearing aids.

According to various embodiments, hearing aid 1430 may comprise any embodiment of any audio system or parametrically formulated noise generator described herein, including for example, parametrically formulated noise generator 100 (see FIG. 1), audio system 700 (see FIG. 7), parametrically formulated noise generator 720 (see FIG. 7), audio system 1210 (see FIG. 12), parametrically formulated noise generator 1220 (see FIG. 12), audio system 1300 (see FIG. 13), parametrically formulated noise generator 1302 (see FIG. 13) or any other embodiment or audio system described or enabled herein, including all embodiments or audio systems enabled, but not specifically enumerated herein.

According to an embodiment, the parametrically formulated noise output from receiver 1450 can be added to the acoustical sound signals entering ear canal 1420 and traveling toward the tympanic membrane 1480.

According to an embodiment, the parametrically formulated noise output of receiver 1450 and the configuration of hearing aid 1430 can reduce or eliminate feedback problems, aesthetics concerns, earwax accumulation issues, maintenance problems, skin irritation, occlusion effect, cost, complexity, and other problems typically associated with hearing aids.

Figure 15:
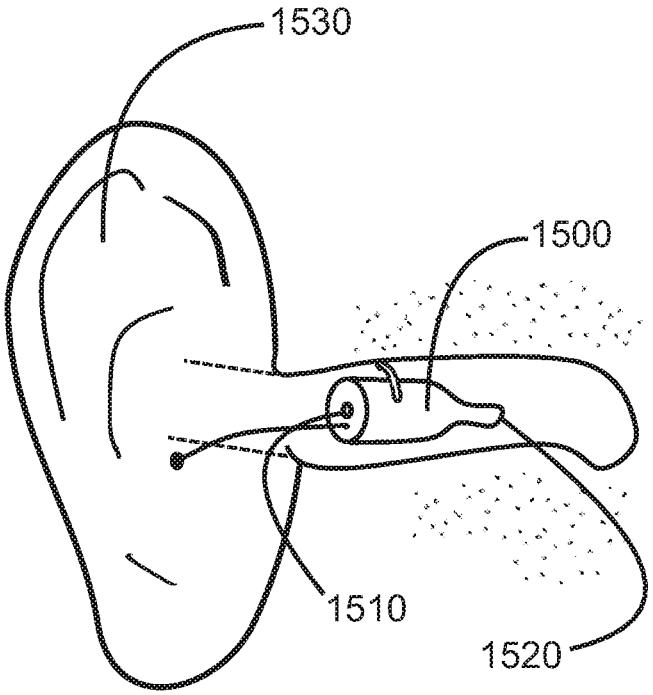
FIG. 15 illustrates a hearing aid in accordance with an embodiment of the present invention.

FIG. 15 illustrates a hearing aid 1500 within an ear 1530. Hearing aid 1500 may be any type of hearing aid including an in-the-ear (ITE) hearing aid, an in-the-canal (ITC) hearing aid, a completely-in-canal (CIC) hearing aid, an invisible-in-canal (IIC) hearing aid, a receiver-in-canal hearing aid (RIC), a behind-the-ear hearing aid (BTE), or any other type of hearing aid known to those skilled in the art. According to an embodiment, hearing aid 1500 or a portion of hearing aid 1500 can be inserted in the ear canal. According to an embodiment, all of hearing aid 1500 or a portion of hearing aid 1500 can be smaller than the ear canal. According to an embodiment, a portion of hearing aid 1500 can make contact to at least one point along the surface of the ear canal. According to an embodiment, a retaining or support device can be used to keep hearing aid 1500 or a portion of hearing aid 1500 from falling out of the ear canal. According to an embodiment, a removal stem may be used to extract hearing aid 1500 or a portion of hearing aid 1500 from the ear canal. According to an embodiment, hearing aid 1500 may comprise any type of hearing aids.

According to various embodiments, hearing aid 1500 may comprise any embodiment of any audio system or parametrically formulated noise generator described herein, including for example, parametrically formulated noise generator 100 (see FIG. 1), audio system 700 (see FIG. 7), parametrically formulated noise generator 720 (see FIG. 7), audio system 1210 (see FIG. 12), parametrically formulated noise generator 1220 (see FIG. 12), audio system 1300 (see FIG. 13), parametrically formulated noise generator 1302 (see FIG. 13) or any other embodiment or audio system described or enabled herein, including all embodiments or audio systems enabled, but not specifically enumerated herein.

According to an embodiment, hearing aid 1500 can have a speaker or receiver 1520 and a microphone 1510. According to an embodiment, hearing aid 1500 can receive an acoustic sound signal containing speech information via microphone 1510, process the signal according to signal processing techniques, and then mix the processed signal with parametrically formulated noise and then output the mixed signal within the ear canal of a user. According to an embodiment, the mixing the parametrically formulated noise signal with the processed signal can increase the speech intelligibility of the signal received by hearing aid 1500.

The configuration of hearing aid 1500 can reduce or eliminate feedback problems, aesthetics concerns, earwax accumulation issues, maintenance problems, skin irritation, occlusion effect, cost, complexity, and other problems typically associated with hearing aids.

Figure 16:
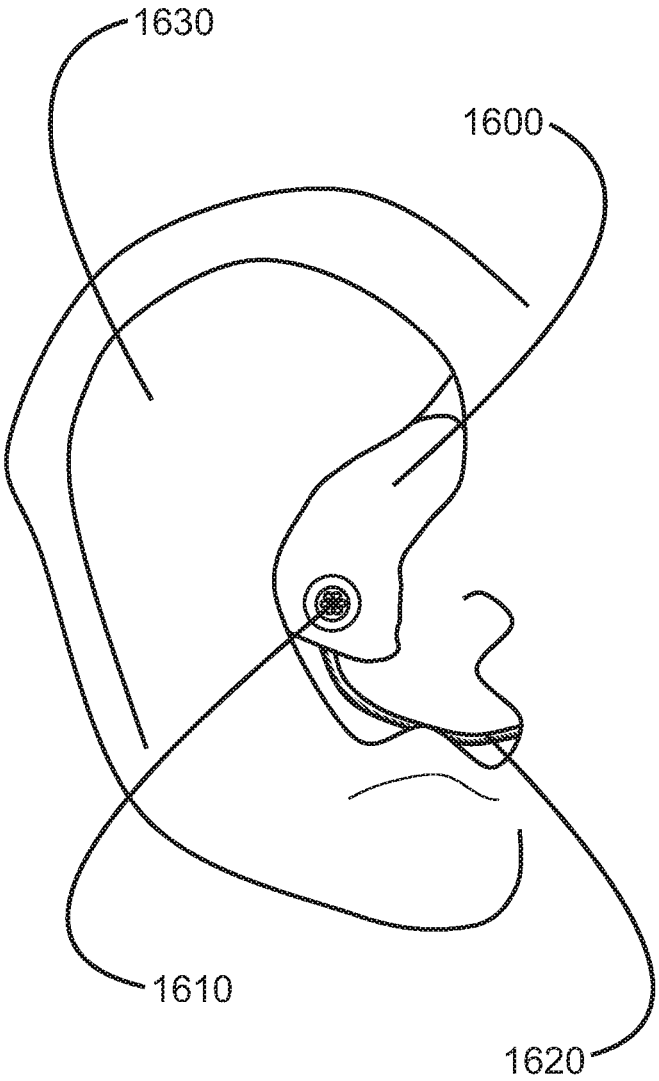
FIG. 16 illustrates a hearing aid in accordance with an embodiment of the present invention.

FIG. 16 illustrates a hearing aid 1600 implementing a parametrically formulated noise generator. According to an embodiment, hearing aid 1600 can be configured similar to hearing aid 1500 (see FIG. 15). According to an embodiment, hearing aid 1600 can be worn in the concha (or bowl) of the ear 1630. Wearing a hearing aid with a microphone 1610 in the concha reduces the effects of audio signal shadowing which can be caused when a microphone is worn behind the ear and can result in a 2 dB to 5 dB loss for frequencies above 1000 Hz. According to an embodiment, a sound tube or speaker 1620 may be used to transmit an audio signal into the ear canal. According to an embodiment, the sound tube or speaker 1620 may also be used as a retention device to keep the hearing aid from falling out of the ear. According to an embodiment, the use of sound tube or speaker 1620 sensitive electronics are kept away from the environment of the ear canal and maintenance issues and as well as irritation issues associated with hearing aids can be reduced.

Figure 17:
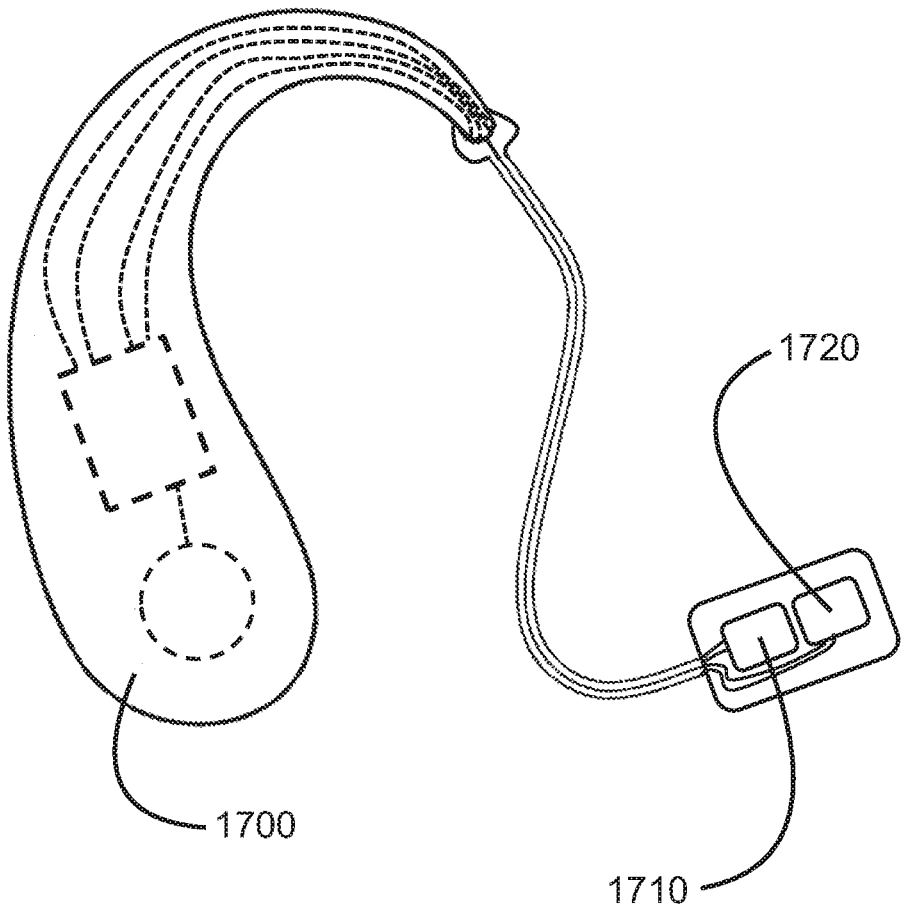
FIG. 17 illustrates a hearing aid in accordance with an embodiment of the present invention.

FIG. 17 illustrates a hearing aid 1700 implementing a parametrically formulated noise generator. Hearing aid 1700 is a form of a BTE hearing aid. Electronics, housing and battery are worn behind the ear. A microphone 1710 and a receiver 1720 can be designed to be placed in the ear canal.

Conventional BTE hearing aids must place the microphone behind the ear to prevent feedback and squealing. Placing the microphone behind the ear creates a shadowing of sound reaching the microphone and can result in a 2 dB to 5 dB loss for frequencies above 1000 Hz, The pinna naturally amplifies sounds reaching the ear canal by approximately 3 dB. According to an embodiment, by using a hearing aid with the microphone in the canal, audio reaching the microphone is 5 dB to 8 dB louder. The signal-to-noise ratio is improved, Using the parametrically formulated noise generator in hearing aid 1700 having feedback suppression as discussed above can enable this new type hearing aid configuration 1800.

In reference to all of the foregoing disclosure, the above described embodiments enable solutions, improvements, and benefits to many problems and issues affecting conventional audio systems and conventional audio devices and offer improved functionality for audio systems and audio devices, for example:

First, amplitude modulated speech information in an audio signal can be boosted or lifted by a parametrically formulated noise signal to make the amplitude modulated speech information audible to a user.

Second, the use of WDRC can be reduced or even eliminated, including where speech information content is critical. WDRC causes amplitude information in the audio signal to be smeared by backwards-looking attack and release time constants. According to various embodiments, no time constants are required to lift the audio above an individual's threshold of hearing and thus there is no smearing as a result. WDRC can push background noise into a speech signal especially during breaks between words. According to various embodiments, there may be no perceived loss in the signal-to-noise ratio by the user and the user may experience even a perceived improvement in the signal-to-noise ratio.

Third, the articulation in speech can be preserved, including for example, the voiced modulation of un-voiced phones.

Fourth, hearing aid feedback or "squealing" can be reduced or eliminated. Feedback or squealing can occur when the loop gain exceeds unity between the microphone and receiver. Given the speed of sound and the physical distance between the microphone and receiver, feedback or "squealing" is reduced or eliminated entirely where parametrically formulated noise is used. According to various of the above described embodiments, parametrically formulated noise can be used at frequencies which are prone to feedback in audio systems and devices. Because phase relationships in parametrically formulated noise are random, constructive interference can be greatly reduced or eliminated.

Fifth, by eliminating feedback or squealing, occluding ear molds can also be eliminated. Generally, one of the main purposes of ear molds is to attenuate feedback when using amplification. Without the need to fight feedback, occlusion can be removed. Eliminating occluding ear molds from hearing aids can have many major benefits. For example, occluding ear molds can cause physical irritation to one's ears. Occluding ear molds can cause the "occlusion effect" which can be uncomfortable for many hearing aid users. Occluding ear molds can accelerate the accumulation of cerumen or earwax. Occluding ear molds can cause an uncomfortable sensation of ear drum pressure while chewing. Furthermore, when using occluding ear molds, sound leakage has often caused hearing healthcare providers to reduce prescribed amplification in high frequency bands in order to prevent feedback associated with amplification. According to the above embodiments, these problems can be eliminated and the hearing health care provider can optimize the gain prescription for maximum speech intelligibility;

Sixth, placing hearing aid electronics behind-the-ear (BTE) or in the concha of the ear, and away from the harsh/moist environment of the ear canal can be one way to reduce long term hearing aid maintenance issues. Using a sound tube between the receiver and the ear canal, however, introduces, among other issues, sound tube resonance issues. The sound tube can become like a "trumpet" at certain frequencies. Sound tube resonances require compensation with hearing aid programming as the length of each sound tube can vary according to the individual. One workaround is the receiver-in-canal (RIC) where most of the electronics can remain BTE while the receiver (i.e. speaker) is placed in the ear canal. The RIC solution can be expensive however, and RIC receivers are still subjected to the harsh, moist environment in the ear canal and can fail much earlier than the remaining portion of the hearing aid behind the ear or in the concha of the ear. According to the above described embodiments, parametrically formulated noise can be random and constructive interference from standing waves in a sound tube can be reduced or eliminated. Furthermore, additional programming is not required to compensate for sound tube length and efficiency of the audio system or audio device is increased. According to the above described embodiments a receiver can be placed BTE with reduced complexity, reduced cost, and improved efficacy;

Seventh, parametrically formulated noise can have advantages for in-the-ear (ITE), completely-in-the-canal (CIC) or similar hearing aids. Most individuals needing a hearing aid have reasonable hearing for voiced phone frequencies. Sensorineural hearing loss is typically more acute at high frequencies. For aesthetic reasons, many consumers desire ITE, CIC or similar hearing aids. According to the above described embodiments, an open-fit (non-occluding) ITE, CIC or similar hearing aid can be created. Parametrically formulated noise can be random and constructive interference can be reduced and/or eliminated. With an open-fit ITE, CIC or similar design, the individual can hear sound via air conduction and the open-fit ITE, CIC or similar hearing aid can implement a parametrically formulated noise generator and mix the parametrically formulated noise with the air conduction signal at a location past the ITE, CIC or similar as the leaking low frequency sound mixes with the parametrically formulated noise produced by the ITE, CIC or similar hearing aid according to various embodiments. The above described embodiments and improvements enable an open-fit (i.e. not fully occluding) ITE, CIC or similar hearing aid effective for those with severe hearing loss;

Eighth, the need for telecoils in hearing aids can be eliminated. Telecoils are used for hearing aids to work with telephones or cell phones. A hearing aid will squeal with feedback if a hearing aid user puts a telephone next to their hearing aid without a telecoil. Hearing aids with telecoils generally switch from a microphone input to the telecoil input. Telecoils generally use magnetic coupling to the telephone or cell phone for sound input. According to the above described embodiments, a hearing aid is enabled which can eliminate feedback or squealing. According to the above described embodiments, a hearing aid microphone can be used with a telephone or cell phone held against the hearing aid. According to the above described embodiments telecoil technology can be eliminated from hearing aids and the complexity and expense of the hearing aid can be reduced;

Ninth, tinnitus can be reduced or eliminated. Tinnitus, or ringing in the ears, is a natural response of the cochlea to the loss of outer hair cells. For persons who experience tinnitus, some of their remaining outer hair cells in their cochlea can be recruited to provide minimum rate encoding to the inner hair cells which causes tinnitus. According to the above described embodiments, an audio system or device, such as a hearing aid, can introduce noise at or just below the threshold of hearing across the entire frequency spectrum for the individual which can reduce or eliminate tinnitus in the individual;

Tenth, problems associated with notches in hearing can be overcome. Notches are common for individuals with severe hearing loss. Notches are frequencies where individuals have little or no sensation of sound. Conventional testing of hearing thresholds at every frequency for a patient would be very tedious and thus notches are often missed by the audiologist or person fitting a hearing aid. According to various of the above described embodiments, parametrically formulated noise can be distributed through each band so that the effect of notches is reduced;

In view of the above it is evident that parametrically formulated noise can be generated to have at least the following characteristics: noise having power spectrum amplitude characteristics formulated to be a function of frequency between a range of two acoustical frequencies; noise having power spectrum amplitude characteristics formulated to be a function of frequency between a range of two acoustical frequencies where such power spectrum amplitude characteristics are discerned even within a relatively short time period such as within the duration of a distinct unit of a speech sound (phoneme) which can be as brief as 30 milliseconds; and, to the extent that any parametrically formulated noise is perceived by a user, it is perceived as having no discernable single frequency emphasis as sensed by an individual.

Benefits, other advantages, and solutions to problems and issues have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

In view of all of the above, it is evident that novel audio systems, audio devices, noise signals, noise generators, and methods are disclosed. Included, among other embodiments, is an audio system which can process an audio signal and improve the speech intelligibility of the audio signal. Improved speech intelligibility can be obtained, according to an embodiment, by mixing parametrically formulated noise with an audio or speech signal. Parametrically formulated noise can be configured to have a power spectrum amplitude that is a function of frequency across as range of frequencies. Furthermore, parametrically formulated noise can have a power spectrum amplitude that is a function of a user's hearing threshold across a range of frequencies. According to an embodiment, parametrically formulated noise can be generated by time ordering a sequence of random or pseudorandom periodic waves having frequencies within a range of frequencies. According to an embodiment, characteristics of the power spectrum amplitude of a parametrically formulated noise across a range of frequencies can be controlled or shaped according to a selection of parameters representative or controlling of a ratio of duration of the various periodic waves used to construct the parametrically formulated noise.

While the subject matter of the invention is described with specific and example embodiments, the foregoing drawings and descriptions thereof depict only typical embodiments of the subject matter, and are not therefore to be considered limiting of its scope. It is evident that many alternatives and variations will be apparent to those skilled in the art and that those alternatives and variations are intended to be included within the scope of the present invention. For example, some embodiments described herein include some elements or features but not other elements or features included in other embodiments, thus, combinations of features or elements of different embodiments are meant to be within the scope of the invention and are meant to form different embodiments as would be understood by those skilled in the art. Furthermore, any of the above-described elements, components, blocks, systems, structures, devices, filters, noise generation methods, ranges and selection of ranges, applications, programming, signal processing, signal analysis, signal filtering, implementations, proportions, flows, or arrangements, used in the practice of the present invention, including those not specifically recited, may be varied or otherwise particularly adapted to specific environments, users, groups of users, populations, manufacturing specifications, design parameters, or other operating requirements without departing from the scope of the present invention. Additionally, the steps recited in any method or processing scheme described above or in the claims may be executed in any order and are not limited to the specific order presented in the above description or in the claims. Finally, the components and/or elements recited in any apparatus claims may be assembled or otherwise operationally configured in a variety of permutations and are accordingly not limited to the specific configuration recited in the claims.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of the invention.

What is claimed is:

1. An audio system for improving hearing ability in an individual, comprising:

a parametrically formulated noise generator, wherein the parametrically formulated noise generator is configured to generate a noise signal substantially within a first range of frequencies, and wherein the noise signal is generated by time ordering a plurality of periodic waves having frequencies within the first range of frequencies, wherein a plurality of parameters representing the ratios of duration of each of the plurality of periodic waves over time are selected such that an average value of a power spectrum of the noise signal across the first range of frequencies is a function of the threshold of hearing for the individual across the first range of frequencies, and wherein the plurality of periodic waves comprise at least a first periodic wave having a first period and a second periodic wave having a second period, wherein the first periodic wave is comprised of a first series of values representing the amplitude of the first periodic wave sampled according to a first sampling rate over a third period of time and wherein the second periodic wave is comprised of a second series of values representing the amplitude of the second periodic wave sampled according to the first sampling rate over a fourth period of time.

2. The audio system of claim 1, wherein the audio system comprises a hearing aid.

3. The audio system of claim 1, wherein the audio system comprises a cell phone.

4. The audio system of claim 1, wherein the audio system comprises a television.

5. The audio system of claim 1, wherein the first range of frequencies is selected to correspond to a range of frequencies where the individual has hearing loss.

6. The audio system of claim 1, wherein time ordering a plurality of periodic waves comprises recursively, pseudorandomly, selecting between at least the first periodic wave and the second periodic wave.

7. The audio system of claim 1, wherein time ordering a plurality of periodic waves comprises recursively, pseudorandomly, selecting between at least a predetermined series of one or more periods of the first periodic wave and a predetermined series of one or more periods of the second periodic wave.

8. The audio system of claim 1, wherein the third period of time multiplied by the first sampling rate is approximately a first integer value and wherein the fourth period of time multiplied by the first sampling rate is approximately a second integer value.

9. A parametrically formulated noise generator, comprising:

a storage device having a lookup table stored within its memory, wherein the lookup table comprises a first series of values corresponding to the amplitude of a first periodic wave sampled according to a first sampling rate over a first period of time, and a second series of values corresponding to the amplitude of a second periodic wave sampled according to the first sampling rate over a second period of time; and a processor, wherein the processor is configured to generate a parametric noise signal by recursively making a random selection between the first series of values and the second series of value and outputting the parametric noise signal, wherein the parametric noise signal comprises a series of values corresponding to each recursively, randomly selected series of values, and wherein a first parameter representing a ratio of duration of the first periodic wave within the parametric noise signal over a third period of time and a second parameter representing the ratio of duration of the second periodic wave over the third period of time can be selected such that an average value of a power spectrum of the parametric noise signal over the third period of time and across a range of frequencies relates to the threshold of hearing of an individual across the range of frequencies.

10. The parametrically formulated noise generator of claim 9, wherein the lookup table further comprises one or more additional series of values corresponding to the amplitudes of one or more additional periodic waves sampled according to the first sampling rate over time, and wherein the processor is configured to generate the parametric noise signal by recursively making a random selection between the first series of values, the second series of values and the one or more additional series of values and outputting the parametric noise signal, and wherein one or more additional parameters representing ratios of duration of the one or more additional periodic waves within the parametric noise signal over the third period of time can be selected such that the average value of a power spectrum of the parametric noise signal across the range of frequencies relates to the threshold of hearing of the individual across the range of frequencies.

11. The parametrically formulated noise generator of claim 9, wherein the range of frequencies corresponds to a range of frequencies where the individual has hearing loss.

12. The parametrically formulated noise generator of claim 9, wherein the third period of time is equal to approximately 50 milliseconds or less.

13. A hearing aid, comprising:

a parametrically formulated noise generator, wherein the parametrically formulated noise generator is configured to generate a parametrically formulated noise signal comprising a time ordered, pseudorandom sequence of periodic waves, wherein the periodic waves comprise at least a first periodic wave and a second periodic wave, wherein the first periodic wave has a first frequency within a first range of frequencies and the second periodic wave has a second frequency within the first range of frequencies, and wherein a first ratio of duration of the first periodic wave within the parametrically formulated noise signal over a first time period and a second ratio of duration of the second periodic wave within the parametrically formulated noise signal over the first time period are configurable according to the hearing ability of a user; and a speaker coupled to the parametrically formulated noise generator and configured to output the parametrically formulated noise signal.

14. The hearing aid of claim 13, wherein the first ratio of duration of the first periodic wave within the parametrically formulated noise signal over the first period of time and the second ratio of duration of the second periodic wave within the parametrically formulated noise signal over the first period of time are selected such that an average power spectrum amplitude of the parametrically formulated noise signal across the first range of frequencies and over the first period of time correlates to the average hearing threshold of the user across the first range of frequencies.

15. The hearing aid of claim 13, wherein the first period of time is equal to approximately 50 milliseconds or less.

16. The hearing aid of claim 13, wherein the hearing aid is completely incorporated within a cell phone.

17. The hearing aid of claim 13, wherein the first range of frequencies corresponds to a range of frequencies where the user has hearing loss.

18. The hearing aid of claim 13, wherein the hearing aid forms a subsystem within an audio transmission system.

* * * * *